US006762016B2

(12) United States Patent
Fujiwara et al.

(10) Patent No.: US 6,762,016 B2
(45) Date of Patent: Jul. 13, 2004

(54) PHOTOTHERMOGRAPHIC MATERIAL

(75) Inventors: Itsuo Fujiwara, Ashigara (JP); Yoshihisa Tsukada, Ashigara (JP); Yasuhiro Yoshioka, Ashigara (JP); Hajime Nakagawa, Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/960,328

(22) Filed: Sep. 24, 2001

(65) Prior Publication Data

US 2002/0064737 A1 May 30, 2002

(30) Foreign Application Priority Data

Sep. 25, 2000 (JP) ..... P.2000-289816

(51) Int. Cl.[7] ..... G03C 1/498; G03C 1/34

(52) U.S. Cl. ..... 430/613; 430/600; 430/609; 430/613; 430/619

(58) Field of Search ..... 430/619, 532, 430/534, 533, 536, 609, 613, 600

(56) References Cited

U.S. PATENT DOCUMENTS 4,562,143 A * 12/1985 Hirabayashi et al. ..... 430/353
5,955,251 A * 9/1999 Koyama et al. ..... 430/532

* cited by examiner

*Primary Examiner*—Thorl Chea
(74) *Attorney, Agent, or Firm*—Birch, Stewart, Kolasch & Birch, LLP

(57) ABSTRACT

A photothermographic material is described, which comprises a support having provided on at least one side thereof a photosensitive silver halide, a photo-insensitive organic silver salt, a reducing agent for silver ion and a binder, wherein at least one layer constituting the photothermographic material comprises an oxazoline compound, by which sufficiently high image density is developed within practically feasible reaction time and temperature, and sufficiently suppressed background coloration is exhibited when stored for a prolonged period after development processing.

16 Claims, No Drawings

PHOTOTHERMOGRAPHIC MATERIAL

FIELD OF THE INVENTION

The present invention relates to photothermographic materials, and specifically those having an improved storage stability after heat development.

BACKGROUND OF THE INVENTION

Recently, in the medical field, it is earnestly demanded to reduce the volume of the processing solution waste from the viewpoints of environment conservation and space saving. To achieve such a demand, technologies are necessary that relate to photothermographic materials used for medical diagnosis and photographic applications, which materials can be efficiently exposed with laser image-setters or laser imagers to form crisp black images of high resolution as well as superior sharpness. Such photothermographic materials eliminate the use of solution type processing chemicals and therefore can provide customers with heat development systems that are simple and environmentally friendly.

Although similar requirements exist also in the field of general image-forming material, medical images must have not only a high image quality excellent in sharpness and graininess as fine descriptions are required, but also are characteristically expected to look blue black for the ease of diagnosis. At present, there is no medical image output system that satisfies the above requirements, though a variety of hardcopy output systems are in practical use for general image formation including inkjet and electrophotographic printers which form images made of pigments or dyes.

On the other hand, thermographic image-recording systems are known as described in, for example, U.S. Pat. Nos. 3,152,904 and 3,457,075, p.279, Chapter 9 of "Thermally Processed Silver Systems" written by D. Klosterboer (Imaging Processes and Materials, Neblette's 8th edition), edited by J. Sturge, V. Walworth and A. Shepp (1989). Generally, a photothermographic material comprises a photosensitive layer comprising a photo-catalyst (such as silver halide) in a catalytic activity quantity, a reducing agent, a reducible silver salt (such as an organic silver salt) and, if needed, a color controlling agent that controls the tone of the silver, all dispersed in a binder matrix. Such a photothermographic material that has been subjected to an image exposure is heated to an elevated temperature (e.g., 80° C.), causing a redox reaction between the silver halide or the reducible silver salt (acting as an oxidant) and the reducing agent to give rise to a black image made of silver. The redox reaction is promoted by the catalytic action of the latent image in the silver halide formed by the exposed light. Accordingly, a black silver image is formed at an exposed area. Techniques related to such materials and image-forming methods are disclosed in many references such as U.S. Pat. No. 2,910,377 and JP-B-43-4924 (The term "JP-B" as used herein means an "examined Japanese patent publication").

As no fixing processing is carried out after heat development for such photothermographic material, the thermally reactive organic silver salt and the reducing agent remain intact in the photosensitive material. These ingredients tend to cause a drawback that the background areas of the heat-developed material turn colored during prolonged storage after processing.

In photothermographic materials, an o-bisphenol compound is often utilized as the reducing agent, as the compound has a desirably high reactivity, as described in, e.g., EP-A-0803764, JP-A-51-51933 and JP-A-6-3793 (The term "JP-A" as used herein means an "unexamined published Japanese patent application"). To impart a sufficiently high heat developablity to the photothermographic material, it is effective to incorporate therein a highly active reducing agent. However, the activity of the reducing agent usually conflicts with the storability of image after processing. Therefore, it has been difficult to simultaneously achieve a high heat developability and a good image storability by selecting the reducing agent alone. Under such circumstance, a new technique of improving image storability has been urgently demanded.

SUMMARY OF THE INVENTION

By taking into consideration the conventional demand described above, the purpose of the invention is to provide a photothermographic material that develops a sufficiently high image density with a feasible reaction temperature and time, and that shows a suppressed trend of coloration at the background area in a prolonged storage after processing.

As a result of their extensive study, the present inventors have found that the use of an oxazoline compound in the photothermographic material is quite effective to achieve the above-described purpose, and have applied this invention.

The invention is to provide a photothermographic material comprising a support having provided on at least one side thereof a photosensitive silver halide, a photo-insensitive organic silver salt, a reducing agent for silver ion and a binder, wherein at least one layer constituting said photothermographic material comprises an oxazoline compound.

The oxazoline compound used in the photothermographic material of the invention is preferably a compound having two or more 2-oxazolyl groups represented by the following formula (1) in the molecule thereof, or a polymer that has in the side chain thereof a 2-oxazolyl group represented by formula (1):

(1)

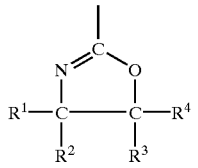

wherein $R^1$, $R^2$, $R^3$ and $R^4$ each independently represents a hydrogen atom, a halogen atom, an alkyl group or an aryl group, and the alkyl group or the aryl group may have a substituent.

In the photothermographic material of the invention, at least one of constitution layer or layers provided on the same side of the support as the layer comprising the photo-insensitive organic silver salt preferably comprises the oxazoline compound. In particular, it is preferable that the layer comprising the photo-insensitive organic silver salt and one or more layer selected from layer or layers adjacent thereto comprises the oxazoline compound.

DETAILED DESCRIPTION OF THE INVENTION

In the following, the photothermographic material of the invention will be explained in detail.

The photothermographic material of the invention comprises a support having provided on at least one side thereof a photosensitive silver halide, a photo-insensitive organic silver salt, a reducing agent for silver ion and a binder. And, as a feature of the photothermographic material of the invention, the material comprises an oxazoline compound in at least one layer constituting the material.

The oxazoline compound used in the invention can be selected from compounds having an oxazolyl group in the molecule. The oxazolyl group may be 2-oxazolyl group, 3-oxazolyl group or 4-oxazolyl group, and 2-oxazolyl group is preferred. The hydrogen atom in these oxazolyl groups may be substituted. No special restriction is imposed on the number of oxazolyl groups present in the oxazoline compound used in the invention, but two or more groups are preferably involved in the molecule, whereby the oxazolyl groups may be the same or different. No special restriction is imposed on the remaining part of the molecule except the oxazolyl group inasmuch as the advantageous features of the invention are realized.

The oxazoline compound used in the invention is preferably a compound having two or more 2-oxazolyl groups, represented by the following formula (1) in the molecule, (1)

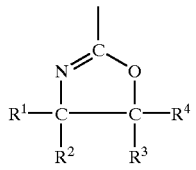

wherein $R^1$, $R^2$, $R^3$ and $R^4$ each independently represents a hydrogen atom, a halogen atom, an alkyl group or an aryl group, and the alkyl group or the aryl group may have a substituent.

More specifically, the preferable oxazoline compounds used in the invention are classified into two classes based on molecular weight and the presence or absence of recurring structure; i.e., (1) low molecular weight compounds having two or more 2-oxazolyl groups and (2) polymeric compounds obtained by homopolymerizing a monomer unit containing a 2-oxazolyl group or copolymerizing such a monomer with other monomer unit(s) copolymerizable with the 2-oxazolyl group-containing monomer.

Each class will be explained in detail below, but the invention should not be construed as being limited to the compound examples enumerated hereinafter.

(1) Low Molecular Weight Compounds Containing Two or More 2-oxazolyl Groups

There is no special restriction on the low molecular weight compound containing two or more 2-oxazolyl groups except this structural condition that the 2-oxazolyl groups are represented by the above-described formula (1), preferable ones being such that the two 2-oxazolyl groups are connected with an organic connecting group. Such an organic connecting group includes di- or poly-valent aromatic hydrocarbon groups having 6 to 20 carbon atoms, di- or poly-valent aliphatic hydrocarbon groups having 1 to 20 carbon atoms, and combinations of these with —O— or —C(=O)NH—. Specific examples of the organic connecting groups include, e.g., a p-phenylene group, an m-phenylene group, a 1,3-naphthylene group, an ethylene group, a butylenes group, a xylene group, an octylene group, a 1,2,3-propanetolyl group, a 1,3-propanediyl-2-ilydene group, and —$CH_2CH_2O$ (C=O)NH—$(CH_2)_n$—NH(C=O) $OCH_2CH_2$— (wherein n is 2, 4 or 6).

The structural formulae of some specific examples of the low molecular weight compound containing two or more 2-oxazolyl groups will follow, but the invention is not restricted to those compound examples at all.

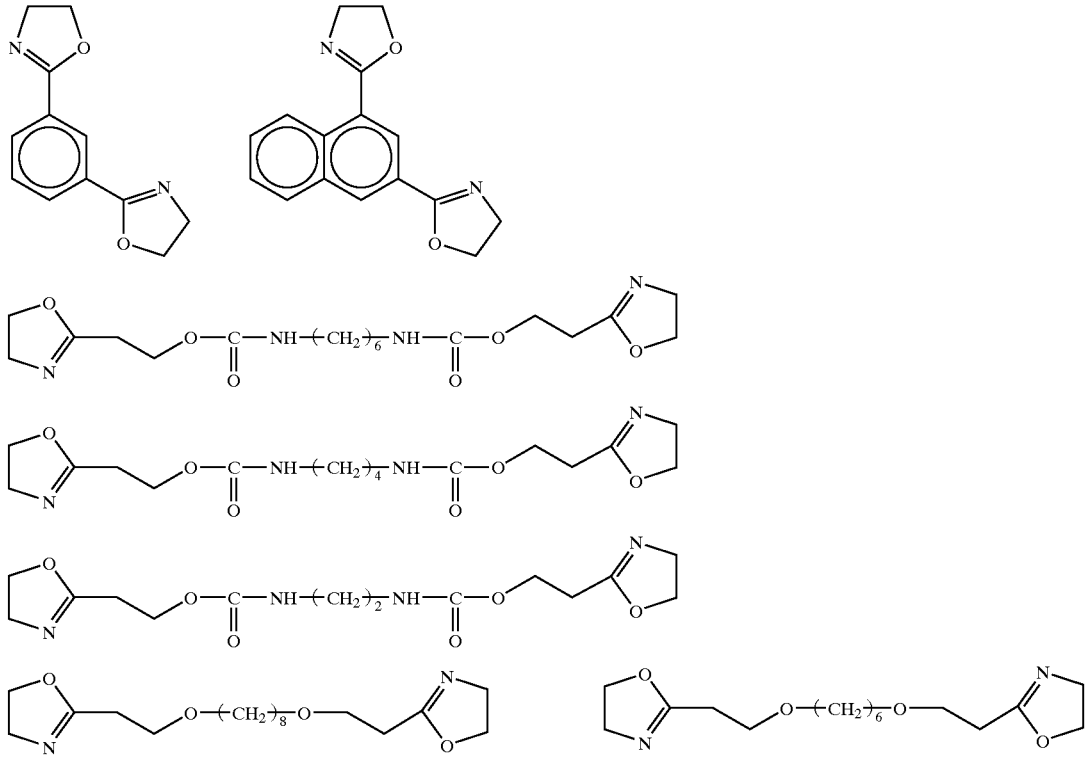

-continued

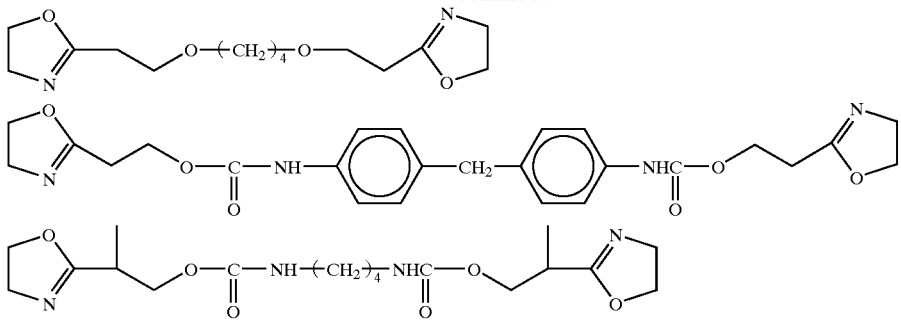

(2) Polymeric Compounds Comprising a Recurring Unit Having a 2-oxazolyl Group in the Side Chain Thereof The polymeric compounds obtained by homopolymerizing a monomer unit containing a 2-oxazolyl group or copolymerizing such a monomer with other monomer unit (s) copolymerizable with the 2-oxazolyl group-containing monomer for use in the invention (which will be referred to briefly as side-chain oxazoline polymer hereinafter) have no special restriction inasmuch as the polymeric compounds contain a recurring unit comprising a monomer having a 2-oxazolyl group. Specifically, polymers resulting from the homopolymerization or copolymerization of a monomer represented by the following formula (2) are preferably used. These polymers may be used solely or in combination with another monomer.

(2)

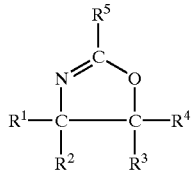

In the formula, $R^1$, $R^2$, $R^3$ and $R^4$ each has the same meaning as in formula (1). $R^5$ represents an organic group having an unsaturated bond that can undergo addition polymerization.

Preferable examples include 2-alkenyl-2-oxazoline (e.g., 2-vinyl-2-oxazoline, 2-vinyl-4-methyl-2-oxazoline, 2-vinyl-5-ethyl-2-oxazoline, 2-isopropenyl-2-oxazoline, 2-isopropenyl-4-methyl-2-oxazoline, 2-isopropenyl-4-ethyl-2-oxazoline or 2-propenyl-4-ethyl-2-oxazoline). Particularly preferable monomers are 2-vinyl-2-oxazoline and 2-isopropenyl-2-oxazoline. These monomers can be used in combination of two or more of them.

The use amount of a monomer represented by formula (2) is not specifically limited. Principally, an appropriate amount required to exert the desirable features that are the purposes of the invention is used depending on the type of the side-chain oxazoline polymer. Usually, a 3% by weight or larger content of the monomer in the total weight of the side-chain oxazoline polymer is preferred, and a 5% by weight or larger content is particularly preferred.

There is no special restriction on the ethylenically unsaturated monomer that is used for copolymerization with the monomer represented by formula (2) used for the side-chain oxazoline polymer according to the invention so long as it is copolymerizable and does not act to open or decompose the oxazoline ring during or after polymerization. Preferable examples of such monomers will be listed below.

1) Olefins and Dienes

Ethylene, propylene, vinyl chloride, vinylidene chloride, 6-hydroxy-1-hexene, cyclopentadiene, 4-pentenic acid, methyl 8-nonanoate, vinylsulfonic acid, trimethylvinylsilane, trimethoxyvinylsilane, 1,3-butadiene, isoprene, 1,3-pentadiene, 2-ethyl-1,3-butadiene, 2-n-propyl-1,3-butadiene, 2,3-dimethyl-1-3-butadiene, 2-methyl-1,3-pentadiene, 1-phenyl-1,3-butadiene, 1-α-naphthyl-1,3-butadiene, 1β-naphthyl-1,3-butadiene, 2-chloro-1,3-butadiene, 1-bromo-1,3-butadiene, 1-chlorobutadiene, 2-fluoro-1,3-butadiene, 2,3-dichloro-1,3-butadiene, 1,1,2-trichloro-1,3-butadiene, 2-cyano-1,3-butadiene, 1,4-divinylcyclohexane or 1,2,5-trivinylcyclohexane.

2) α,β-Unsaturated Carboxylic Acids and Salts Thereof

Acrylic acid, methacrylic acid, itaconic acid, maleic acid, sodium acrylate, ammonium methacrylate, or potassium itaconate.

3) Derivatives of α,β-unsaturated Carboxylic Acid

3a) Alkyl Acrylates

Methyl acrylate, ethyl acrylate, n-propyl acrylate, isopropyl acrylate, n-butyl acrylate, isobutyl acrylate, sec-butyl acrylate, tert-butyl acrylate, amyl acrylate, n-hexyl acrylate, cyclohexyl acrylate, 2-ethylhexyl acrylate, n-octyl acrylate, tert-octyl acrylate, dodecyl acrylate, phenyl acrylate, benzyl acrylate, 2-chloroethyl acrylate, 2-bromoethyl acrylate, 4-chlorobutyl acrylate, 2-cyanoethyl acrylate, 2-acetoxyethyl acrylate, dimethylaminoethyl acrylate, methoxybenzyl acrylate, 2-chlorocyclohexyl acrylate, furfuryl acrylate, tetrahydrofurfuryl acrylate, 5-hydroxypentyl acrylate, 2,2-dimethyl-3-hydroxypropyl acrylate, 2-methoxyethyl acrylate, ω-methoxypoly(ethylene glycol) acrylate (molar number of added polyoxyethylene n=2 to 100), 3-methoxybutyl acrylate, 2-ethoxyethyl acrylate, 2-butoxyethyl acrylate, 2-(2-butoxyethoxy)ethyl acrylate, 1-bromo-2-methoxyethyl acrylate, 1,1-dichloro-2-ethyoxyethyl acrylate or glycidyl acrylate.

3b) Alkyl Methacrylates

Methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, n-hexyl methacrylate, cyclohexyl methacrylate, 2-ethylhexyl methacrylate, n-octyl methacrylate, stearyl methacrylate, benzyl methacrylate, phenyl methacrylate, allyl methacrylate, furfuryl methacrylate, tetrahydrofurfuryl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, ω-methoxypoly(ethylene glycol) methacrylate (molar number of added polyoxyethylene n=2 to 100), poly(ethylene glycol) monomethacrylate (molar number of added polyoxyethylene n=2 to 100), poly(propylene glycol) monomethacrylate (molar number of added polyoxypropylene n=2 to 100), 2-acetoxyethyl methacrylate, 2-ethyoxyethyl methacrylate, 2-butoxyethyl methacrylate, 2-(2-butoxyethoxy)ethyl methacrylate, glycerin monomethacrylate, glycidyl methacrylate, 3-N,N-dimethylaminopropyl methacrylate, chloro-3-N,N,N-trimethylammonio-propyl methacrylate, 2-carboxyethyl methacrylate, 3-sulfopropyl methacrylate, 4-oxysulfobutyl methacrylate, 3-trimethoxysilylpropyl methacrylate, allyl methacrylate or 2-isocyanatoethyl methacrylate.

3c) Esters of Unsaturated Polyvalent (Polybasic) Carboxylic Acids

Monobutyl maleate, dimethyl maleate, dibutyl maleate, monomethyl itaconate, dimethyl itaconate, dibutyl itaconate, butyl crotonate, hexyl crotonate, diethyl fumarate or dimethyl fumarate.

3d) Esters of Polyfunctional Alcohols

Ethylene glycol diacrylate, ethylene glycol dimethacrylate, diethylene glycol diacrylate, diethylene glycol dimethacrylate, triethylene glycol diacrylate, triethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, 1,2,4-cyclohexane tetramethacrylate, or poly (propylene glycol dimethacrylate (molar number of added polyoxypropylene n=2 to 100).

3e) Amides of α,β-unsaturated Carboxylic Acids

Acrylamide, methacrylamide, N-methylacrylamide, N-ethylmethacrylamide, N,N-dimethylacrylamide, N-hydroxyethylmethacrylamide, N-tert-butylacrylamide, N-tert-octylmethacrylamide, N-cyclohexylacrylamide, N-hydroxymethylacrylamide, N-phenylacrylamide, N-(2-acetoacetoxyethyl)acrylamide, N-benzylacrylamide, N-acryloylmorpholine, diacetoneacrylamide, itaconic acid diamide, N-methylmaleimide, 2-acrylamide-methylpropanesulfonic acid, methylnebisacrylamide or dimethacryloylpyperadine.

4) Unsaturated Nitriles

Acrylonitrile or methacrylonitrile.

5) Styrene and Derivatives Thereof

Styrene, vinyltoluene, ethylstyrene, p-tert-butylstyrene, p-vinylbenzoic acid, methyl p-vinylbenzoate, α-methylstyrene, p-chloromethylstyrene, vinylnaphthalene, p-methoxystyrene, p-hydroxymethylstyrene, p-acetoxystyrene, p-styrenesulfonic acid, sodium p-styrenesulfonate, potassium p-styrenesulfinate, p-aminomethylstyrene, p-divinylbenzene or 4-vinylbenzoic acid-2-acryloylethyl ester.

6) Vinyl Ethers

Methyl vinyl ether, butyl vinyl ether, hexyl vinyl ether or methoxyethyl vinyl ether.

7) Vinyl Esters

Vinyl acetate, vinyl propionate, vinyl lactate, vinyl isolactate, vinyl benzoate, vinyl salicylate, vinyl chloroacetate, vinyl methoxyacetate or vinyl phenylacetate.

8) Other Polymerizable Monomers

N-vinylimidazole, 4-vinylpyridine, N-vinyl-pyrrolidone, divinylsulfone, methyl vinyl ketone, phenyl vinyl ketone or methoxyethyl vinyl ketone.

In order to regulate the physical properties of the resulting polymer, one or more kinds of monomers can be properly selected from those enumerated above for copolymerization. From the standpoint of ease of polymerization, α,β-unsaturated carboxylic acid derivatives, vinyl esters, conjugated dienes and styrene compounds are preferred.

The form of the side-chain oxazoline polymer used in the invention is not restricted inasmuch as it is applicable to the manufacture of photothermographic materials. By taking into account the applicability to thin layer coating in the form of liquid (e.g., hot melt, solution or dispersion), particularly in the form of aqueous medium, the form of aqueous polymer solution or aqueous dispersion of fine polymer particles is especially preferred. Examples of aqueous dispersions comprising fine polymer particles include polymer emulsions prepared by emulsifying a water-immiscible solvent (e.g., ethyl acetate or methyl ethyl ketone) solution of a polymer into an aqueous medium with the aid of a surfactant or protective colloid, and polymer latices dispersed directly by a polymerization reaction carried out in an aqueous medium. Between these two types of dispersion, the latter form (latex) is particularly favorable for the present invention due to its capability of making the dispersed particles very fine, an excellent dispersion stability and need of very small amount of surfactant.

The side-chain oxazoline polymer used in the invention can be prepared by ordinary processes including solution, emulsion, dispersion and suspension polymerizations. Among them, solution and emulsion polymerization processes are suited for the invention. When such a polymer is used, the particle diameter not exceeding 500 nm is usually preferred. More preferably, dispersed particles with diameters not larger than 200 nm, and still more preferably those with diameters not larger than 150 nm are used.

Emulsion polymerization uses a dispersion medium comprising water or a mixture of water and a water-miscible organic solvent such as methanol, ethanol or acetone, in which a monomer mixture in an amount of 5 to 40% by weight of the medium, a polymerization initiator in an amount of 0.05 to 5% by weight of the monomer and an emulsifier in an amount of 0.1 to 20% by weight of the monomer are incorporated. Such polymerization mixture is stirred for 3 to 8 hours at 30 to 100° C., more preferably at 60 to 90° C., to cause the polymerization of the monomer. The reaction conditions including dispersion medium, monomer concentration, the quantity of the initiator as well as the emulsifier, reaction temperature and time and the method of monomer introduction are appropriately determined by taking into consideration of various factors such as the type of the monomer used and the particle diameter to be achieved.

Preferable initiators used for emulsion polymerization include inorganic peroxides such as potassium persulfate or ammonium persulfate, azonitrile compounds such as sodium azobiscyanovalerate, azoamidine compounds such as 2,2'-azobis(2-amidinopropane) dihydrochloric acid salt, cyclic azoamidine compounds such as 2,2'-azobis[2-(5-methyl-2-imidazoline-2-yl)propane] hydrochloric acid salt and azoamide compounds such as 2,2'-azobis{2-methyl-N-[1,1'-bis(hydroxymethyl)-2-hydroxyethyl]propionamide}. Among these compounds, potassium persulfate or ammonium persulfate is particularly preferred.

Suitable dispersants include an anionic surfactant, a nonionic surfactant, a cationic surfactant or an amphoteric surfactant, among which the anionic one is preferred.

Solution polymerization is carried out in a medium comprising water or an organic solvent (e.g., ethanol, acetone, methyl ethyl ketone or ethyl acetate) with use of a monomer mixture in an amount of 5 to 100% by weight of the medium, and a polymerization initiator in an amount of 0.05 to 5% by weight of the monomer. Such polymerization mixture is stirred for 3 to 8 hours at a temperature of between 30° C. and around the boiling point of the medium, more preferably at 60 to 90° C., to cause the polymerization of the monomer. The reaction conditions including medium, monomer concentration, the quantity of the initiator, reaction temperature and time and the method of monomer introduction are appropriately determined by considering the type of the monomer used and the molecular weight to be achieved.

Initiators preferably used in solution polymerization include inorganic peroxides such as potassium persulfate or ammonium persulfate, azo compounds such as azobisbutylonitrile, azobisisovaleronitrile, sodium azobisicyanovalerate, dihydrochloric acid salt of 2,2'-azobis (2-amidinopropane), hydrochloric acid salt of 2,2'-azobis[2-(5-methyl-2-imidazoline-2-yl)propane], or 2,2'-azobis{2-(methyl-N-[1,1'-bis(hydroxymethyl)-2-hydroxyethyl] propionamide}.

On the synthesis of the side-chain oxazoline polymer used in the invention, descriptions are given in, e.g., JP-A-10-226756, JP-A-9-31292 and JP-A-2-99537. Commercially available latices comprising the side-chain oxazoline polymer applicable to the invention are exemplified by Epocross K-1010E, K-1020E, K-1030E, K-2010E, K-2020E and K-2030E manufactured by Nippon Shokubai Co., Ltd.

In Table 1 below, some preferable examples of the side-chain oxazoline polymer latex will be shown not to limit the scope of the invention thereto.

TABLE 1

| No. | Structure (composition in % by weight) | Molecular Weight | Conc. (% by weight) | Particle diameter (nm) |
|---|---|---|---|---|
| P-1 | Methyl acrylate (45)/styrene (50)/2-vinyloxazoline (5) | 84000 | 36.6 | 113 |
| P-2 | Methyl acrylate (45)/styrene (50)/2-isopropenyloxazoline (5) | 96000 | 37.2 | 118 |
| P-3 | Methyl acrylate (55)/styrene (40)/2-isopropenyloxazoline (5) | 59000 | 35.5 | 116 |
| P-4 | Butyl methacrylate (55)/methyl methacrylate (40)/2-vinyloxazoline (5) | 103000 | 33.1 | 96 |
| P-5 | Butyl acrylate (45)/styrene (50)/2-isopropenyloxazoline (5) | 66000 | 39.9 | 101 |
| P-6 | 2-Ethylhexyl acrylate (40)/styrene (50)/2-isopropenyloxazoline (10) | 72000 | 35.1 | 109 |
| P-7 | Butyl acrylate (40)/styrene (45)/divinylbenzene (10)/2-isopropenyloxazoline (5) | Cross-linked | 38.2 | 90 |
| P-8 | Butyl acrylate (35)/-styrene (40)/divinyl-benzene (15)/2-iso-propenyloxazoline (10) | Cross-linked | 37.2 | 92 |
| P-9 | Butyl acrylate (45)/styrene (35)/divinylbenzene (10)/2-isopropenyloxazoline (10) | Cross-linked | 40.2 | 106 |
| P-10 | Benzyl methacrylate (50)/styrene (35)/divinylbenzene (10)/2-isopropenyloxazoline (5) | Cross-linked | 38.3 | 99 |
| P-11 | 2 -Ethylhexyl acrylate (40)/styrene (30)/divinylbenzene (15)/2-isopropenyloxazoline (15) | Cross-linked | 35.5 | 122 |

TABLE 1-continued

| No. | Structure (composition in % by weight) | Molecular Weight | Conc. (% by weight) | Particle diameter (nm) |
|---|---|---|---|---|
| P-12 | Vinyl acetate (40)/styrene (45)/divinylbenzene (10)/2-isopropenyloxazoline (5) | Cross-linked | 30.2 | 133 |
| P-13 | Butyl methacrylate (95)/2-isopropenyloxazoline (5) | 52000 | 33.3 | 102 |
| P-14 | Butyl acrylate (35)/styrene (40)/ethylene glycol dimethacrylate (15)/2-isopropenyloxazoline (10) | Cross-linked | 29.3 | 112 |
| P-15 | Butyl acrylate (40)/methyl methacrylate (40)/divinylbenzene (10)/2-isopropenyloxazoline (10) | Cross-linked | 36.8 | 99 |

On the synthesis of the water-soluble side-chain oxazoline polymer used in the invention, descriptions are given in, e.g., JP-A-6-145345, JP-A-6-32844 and JP-A-5-295275. Commercially available water-soluble side-chain oxazoline polymers applicable to the invention are exemplified by Epocross WS-300 and WS-500 manufactured by Nippon Shokubai Co., Ltd.

In Table 2 below, some preferable examples of the water-soluble side-chain oxazoline polymer will be shown not to limit the scope of the invention thereto.

TABLE 2

| No. | Structure (composition by % by weight) | Molecular weight |
|---|---|---|
| Q-1 | 2-Vinyloxazoline (100) | 43000 |
| Q-2 | 2-Isopropenyloxazoline (100) | 36000 |
| Q-3 | 2-Vinyloxazoline (50)/2-isopropenyloxazoline (50) | 39000 |
| Q-4 | Butyl methacrylate (25)/2-vinyloxazoline (75) | 55000 |
| Q-5 | 2-Hydroxyethyl acrylate (30)/2-isopropenyloxazoline (70) | 49000 |
| Q-6 | Acrylamide (70)/2-isopropenyloxazoline (30) | 126000 |
| Q-7 | N-Vinylpyrrolidone (80)/2-isopropenyloxazoline (20) | 89600 |
| Q-8 | N-Vinylpyrrolidone (60)/2-isopropenyloxazoline (40) | 66000 |
| Q-9 | Na acrylamide-2,2-dimethylpropanesulfonate (30)/2-isopropenyloxazoline (70) | 56000 |
| Q-10 | Methacrylic acid-3-propylsulfonic acid Na salt (50)/2-isopropenyloxazoline (50) | 44000 |

Though the oxazoline compound of the invention can be incorporated into any layer constituting the photothermographic material, incorporation in a constitution layer provided on the same side of the support as the layer that comprises the photo-insensitive organic silver salt is preferred. Or the compound can preferably be incorporated in the layer containing the photo-insensitive organic silver salt and/or a layer or layers adjacent thereto. Any of the oxazoline compounds for use in the invention can be used individually or in combination of two or more of them. Oxazoline compounds that assume a colorless and transparent or semi-transparent state in the coated film are preferred.

The pH of the coating mixture to which the oxazoline compound for use in the invention is added is preferably from 3.0 to 12.0, more preferably from 4.0 to 10.0, and still more preferably from 5.0 to 10.0.

The oxazoline compound for use in the invention can be added to the coating mixture either as an ingredient incorporated in a binder solution prepared beforehand, at the last step of the preparation of the coating mixture, or just before coating.

The use amount of the oxazoline compound for use in the invention is preferably in a range of 0.5 to 200% by weight, more preferably 2 to 100% by weight, and still more preferably 3 to 50% by weight of the binder for the constitution layer in which the compound is incorporated.

Now, the organic silver salt used in the invention will be explained in detail.

The organic silver salts applicable to the invention are those relatively stable to light, but able to form a silver image when heated to 80° C. or higher under the presence of an exposed photo-catalyst (e.g., latent images formed in photosensitive silver halide) and a reducing agent. Such photo-insensitive organic silver salts may be of arbitrary organic materials containing a source for the reduction of silver ion. As the photo-insensitive organic silver salts satisfying these conditions, the silver salts of organic acids described in paragraph Nos. 0048 to 0049 of JP-A-10-62899 and in the 24th line, p. 18 to the 37th line, p.19 of EP-A-0803764 are preferred. Particularly, the silver salt of a long-chain aliphatic carboxylic acid having 10 to 30 carbon atoms, and more preferably 15 to 28 carbon atoms are preferred. Specific examples of such preferable organic silver salts include, silver behenate, silver alachidate, silver stearate, silver oleate, silver laurate, silver capronate, silver milistate and silver palmitate. Mixtures of these salts can also be used.

The organic silver salt used in the invention can take any grain shape without special limitation, but scaly ones are preferred. In the present specification, a scaly organic silver salt is defined as follows. A sample of an organic silver salt grain is observed with an electron microscope. The shape of the grains is approximated by a rectangular parallelepiped, the three edge lengths of which are designated A, B and C in extending order whereby C may be equal to B. By using the smaller two values A and B thus defined, a value x is obtained as $$x=B/A$$

From the x's on about 200 grains, the average value, x(average) is obtained. When x(average) is not smaller than 1.5 {x(average)≧1.5}, the grain group is described as scaly. Preferably, 30≧x(average)≧1.5, and more preferably, 20≧x (average)≧2.0. Incidentally, for needle shape, 1.5>x (average)≧1.

In a scaly grain, A can be regarded as the thickness of a tabular grain in which the plane having the edges of B and C in length forms the main plane. The average length of A is preferably 0.01 to 0.23 μm, and more preferably 0.1 to 0.20 μm. The average value of C/B is preferably 1 to 6, more preferably 1.05 to 4, still more preferably 1.1 to 3, and particularly preferably 1.1 to 2.

The organic silver salt preferably has a mono-disperse size distribution. In such a mono-disperse distribution, the standard deviation of the short or long axis divided by the corresponding axial length expressed in percentage does not exceed 100% preferably, be more preferably up to 80%, and particularly preferably up to 50%. The shape of the organic silver salt can be measured from transmission electron micrographs of the dispersion of the salt. Another method of measuring the degree of mono-dispersion is based on the standard deviation of the volume-weighted average diameter of the organic silver salt. In such a method, the standard deviation of the volume-weighted average diameter divided by the volume-averaged diameter expressed in percentage (coefficient of variation) does not exceed 100% preferably, more preferably be not larger than 80%, and still more preferably not larger than 50%. The coefficient of variation can be calculated with the grain size (volume-weighted average diameter) obtained by irradiating laser light to the organic silver salt dispersed in a liquid, and deriving the auto-correlation function for the temporal change in the fluctuation of the light scattered by the dispersion.

The organic silver salt used in the invention can be prepared by reacting the solution or suspension of the alkali metal (Na, K or Li) salt of the organic acid cited previously with silver nitrate. The alkali metal salt of the organic acid can be prepared by treating the organic acid with an alkaline compound. The organic silver salt can be prepared via a batch or continuous mode in an arbitrary, suitable reaction vessel. The reaction mixture in the vessel can be stirred by an arbitrary agitation method according to the characteristics required to the resulting grains. In the preparation of the organic silver salt, such processes can be preferably adopted as one comprising gradual or abrupt addition of silver nitrate aqueous solution to the reaction vessel containing the solution or suspension of the alkali metal salt of an organic acid, one comprising gradual or abrupt addition of the solution or suspension of the alkali metal salt of an organic acid having been prepared beforehand to the vessel containing the silver nitrate aqueous solution, or one comprising simultaneous injection of the silver nitrate aqueous solution and the solution or suspension of the organic alkali metal salt of the organic acid, both having been prepared beforehand, into the reaction vessel.

The concentration of silver nitrate aqueous solution and the solution or suspension of the alkali metal salt of the organic acid can be varied arbitrarily, and the addition rate can be also varied arbitrarily in order to control the grain size of the organic silver salt. The mode of addition of silver nitrate aqueous solution and the solution or suspension of the alkali metal salt of an organic acid includes one based on a constant addition rate, and one based on accelerated or decelerated addition rate obeying an arbitrary temporal function. The addition to the reaction solution or suspension may be made either at the liquid surface or in the liquid volume. In the method comprising simultaneous injection of silver nitrate aqueous solution and the solution or suspension of the alkali metal salt of an organic acid, both having been prepared in advance, into the reaction vessel, the injection of either reaction component may precede that of the other. The injection of silver nitrate aqueous solution is preferably preceded. The degree of precession is preferable from 0 to 50% by volume, and more preferably from 0 to 25% by volume relative to the total amount of the solution. As is described in JP-A-9-127643, an addition method in which the pH or the silver potential of the reactant is controlled during reaction is preferably adopted in the invention.

The pH of the silver nitrate aqueous solution and the solution or suspension of the alkali metal salt of the organic acid can be appropriately controlled depending on the property required to the resulting grains with use of an arbitrary acid or base material. At the same time, the temperature inside the reaction vessel can be appropriately set depending on the property required to the resulting grains, for example, in order to control the size of the resulting grains of the organic silver salt. Needless to say, the temperature of silver nitrate aqueous solution as well as the solution or suspension of the alkali metal salt of the organic acid can be appropriately set at arbitrary values. In order to secure a sufficient level of fluidity, the solution or suspension of the alkali metal salt of the organic acid is kept at a temperature not lower than 50° C.

The organic silver salt to be used in the invention can be preferably prepared in the presence of a tertiary alcohol. Tertiary alcohols having up to 15, more preferably up to 10 carbon atom in total are preferable. An example of such preferable tert-alcohols is tert-butanol. Though the tert-alcohol can be added at any time during the preparation of the organic silver salt, a preferable method is to use the tert-alcohol in the preparation of the alkali metal salt of an organic acid so as to dissolve the salt. The tert-alcohol is used in a weight ratio of 0.01 to 10, and more preferably 0.03 to 1 to the amount of water used as the solvent in the preparation of the organic silver salt.

Scaly organic silver salt grains to be used in the invention can be preferably prepared in the following manner. In the step where an aqueous solution containing a water-soluble silver salt is reacted with a solution comprising the alkali metal salt of an organic acid dissolved in a tert-alcohol-containing aqueous solution in the reaction vessel (The step contains the injection of the latter solution to the liquid in the reaction vessel.), a temperature difference is provided of at least 20° C. but not exceeding 85° C. between the liquid placed in the vessel and the solution comprising the alkali metal salt of an organic acid dissolved in a tert-alcohol-containing aqueous solution. In the above description, 'the liquid charged in the vessel' means the aqueous solution containing a water-soluble silver salt injected in precession, or a solvent comprising pure water or tert-alcohol-containing water for the case where the two reaction components are simultaneously injected as will be explained soon. Such a solvent comprising pure water or tert-alcohol-containing water may be charged in the vessel in advance even when the addition of the aqueous solution containing water-soluble silver salt precedes.

By maintaining such a temperature difference during the addition of the tert-alcohol-containing aqueous solution containing the alkali metal salt of an organic acid, the crystal form of the resulting organic silver salt can be preferably regulated.

As the water-soluble silver salt, silver nitrate is preferred; its concentration in aqueous solution is preferably 0.03 to 6.5 mol/l, and more preferably 0.1 to 5 mol/l, and the pH of the solution is preferably 2 to 6, more preferably from 3.5 to 6.

The tert-alcohol to be preferably used contains 4 to 6 carbon atoms; such alcohols occupy up to 70% by volume, more preferably up to 50% by volume of the total volume of the aqueous solution of the water-soluble silver salt. The temperature of the aqueous solution is preferably 0 to 50° C., and more preferably 5 to 30° C. In the case where the aqueous solution containing water-soluble silver salt and the tert-alcohol-containing aqueous solution of the alkali metal salt of an organic acid are simultaneously injected, a temperature between 5 and 15° C. is preferably chosen for the aqueous solution, as will be described later.

As the alkali metal suited for the formation of the salt of an organic acid, Na and K are preferred. The alkali metal salt of an organic acid can be prepared by adding NaOH or KOH to the organic acid. In such a reaction, the alkali metal is preferably used in an amount less than the equivalent moles of the organic acid to leave a certain amount of unreacted free acid. The residual amount of organic acid is preferably 3 to 50, and more preferably 3 to 30 mole % of the total acid amount. Alternatively, a similar product can be prepared by first using an excessive amount of alkali, and then adding an acid such as nitric acid or sulfuric acid to neutralize the excessive alkali.

The pH may be adjusted depending on the property required to the resulting organic silver salt with use of an arbitrary acid or base.

The solution containing a water-soluble silver salt, the tert-alcohol-containing aqueous solution of the alkali metal salt of an organic acid, or the liquid charged in the reaction vessel may further contain a compound represented by formula (1) of JP-A-62-65035, a N-containing heterocyclic compound having a water-soluble group described in JP-A-62-150240, an inorganic peroxide described in JP-A-50-101019, a sulfur compound described in JP-A-51-78319, a disulfide compound described in JP-A-57-643 or hydrogen peroxide.

The tert-alcohol-containing aqueous solution of the alkali metal salt of an organic acid preferably be a mixture of water with a tert-alcohol of 4 to 6 carbon atoms to secure a homogeneousness of the solution. Those of 7 carbon atoms or more are not preferred due to the lack of compatibility with water. Among the $C_{4-6}$ tert-alcohols, tert-butanol is most preferred due to the highest compatibility with water. Alcohols other than tertiary ones are not preferred as they have a reducing property, thus exerting an adverse effect in the formation of the silver salt of an organic acid. The amount of the tert-alcohol used in the tert-alcohol-containing aqueous solution of the alkali metal salt of an organic acid is preferably 3 to 70% by volume, and more preferably 5 to 50% by volume of the total volume of water in the solution.

The concentration of the alkali metal salt of the organic acid in the tert-alcohol-containing aqueous solution is 7 to 50% by weight, preferably 7 to 45% by weight, and more preferably 10 to 40% by weight.

The temperature of the tert-alcohol-containing aqueous solution of the alkali metal salt of an organic acid to be added to the reaction vessel is kept preferably at 50 to 90° C., more preferably at 60 to 85° C., and most preferably at 65 to 85° C. in order to prevent the alkali metal salt of an organic acid from crystallization or solidification. Further, to keep the reaction temperature constant, the solution temperature is preferably controlled at a constant value selected from the range described above.

The organic silver salt to be preferably used in the invention can be prepared either by i) a single addition method comprising adding the tert-alcohol-containing aqueous solution of the alkali metal salt of an organic acid into the aqueous solution of the water-soluble silver salt the total amount of which is placed in the reaction vessel in advance, or by ii) a simultaneous addition method that involves a period in which the aqueous solution of the water-soluble silver salt and the tert-alcohol-containing aqueous solution of the alkali metal salt of an organic acid are added simultaneously into the reaction vessel. Between these, the latter is preferred as it can better control the average grain size of the resulting organic silver salt, thus achieving narrow size distributions. In the latter method, preferably not less than 30% by volume, and more preferably 50 to 75% by volume of the total added amount is injected simultaneously. If either solution is to be added in precession, the solution of the water-soluble silver salt is preferably selected.

In either addition method, the liquid present in the reaction vessel (which means either of the solution of the water-soluble silver salt precedently added, or else the solvent having been charged in the vessel prior to the reactant addition) is kept preferably between 5 and 75° C., more preferably between 5 and 60° C., and most preferably between 10 and 50° C. The temperature of the liquid is preferably kept constant at a value selected from the range described above during the whole reaction period, or is preferably controlled by a number of temperature patterns fallen within the range described above.

The temperature difference between the tert-alcohol-containing aqueous solution of the alkali metal salt of an organic acid and the solvent in the vessel is preferably 20 to 85° C., and more preferably 30 to 80° C. Here, the temperature of the tert-alcohol-containing aqueous solution of the alkali metal salt of the organic acid is preferably higher.

By adopting any of the methods described heretofore, the speed with which the alkali metal salt of an organic acid separates as fine crystals when the hot tert-alcohol-containing aqueous solution thereof is rapidly cooled in the vessel, and the speed of the organic silver salt formation by the reaction with the water-soluble silver salt are favorably controlled, thus forming an organic silver salt having a desirable crystal shape, crystal size and size distribution. At the same time, the capabilities as a photothermographic material improve.

In the reaction, the reaction vessel may contain a solvent prior to the reactant addition. As such a solvent, water and aqueous mixtures with one of the tert-alcohols described previously are preferably used.

The tert-alcohol-containing aqueous solution of the alkali metal salt of an organic acid, the aqueous solution of a water-soluble silver salt, or the reaction liquid can contain a dispersion aid soluble in aqueous media. Any type of dispersion aid can be used provided that it can well disperse the organic silver salt formed. Specific examples appear in the description on the dispersion aid for organic silver salts to be shown later.

In the preparation of organic silver salts, it is desirable to subject the salt to desalting and dehydrating operations after grain formation. Any known conventional method can be applied including various filtration methods such as centrifugal, suction, ultrafiltration, flock washing based on flocculation, and centrifugal separation-sedimentation followed by supernatant removal. The desalting and dehydrating operations may be performed once or repeatedly. Water addition and removal may be made continuously or stepwise. The desalting and dehydration are performed in such a manner that the finally removed water has an electric conductivity not exceeding preferably 300 $\mu$S/cm, more preferably 100 $\mu$S/cm, and most preferably 60 $\mu$S/cm. There is no special lower limit for the conductivity, which is usually about 5 $\mu$S/cm.

Further, to make the surface structure of the coating of the photothermographic material desirable, it is preferred to prepare a very fine dispersion of the organic silver salt by converting the aqueous dispersion thereof once formed to a high-speed stream by means of high pressure, and re-dispersing it by subsequent pressure reduction. For such operation, the dispersing medium preferably consists solely of water, but may contain an organic solvent in an amount not exceeding 20% by weight.

Mechanical methods of dispersing the organic silver salt include those using any finely dispersing means well known in the presence of dispersion aid. Such means includes, for example, high-speed mixer, homogenizer, high-speed impact mill, Bambury mixer, homo-mixer, kneader, ball mill, vibrating ball mill, planet ball mill, attritor, sand mill, bead mill, colloid mill, jet mill, roller mill, thoron mill and high-speed stone mill.

When a photosensitive silver salt is allowed to coexist during the dispersion of the organic silver salt, the fog increases and the sensitivity considerably drops. Thus substantially no photosensitive silver salt is preferably contained during the dispersion of the organic silver salt. The amount of a photosensitive silver salt in the aqueous dispersion does not exceed 0.1 mole % per one mole of the organic silver salt in the aqueous dispersion with no intentional incorporation of a photosensitive silver salt.

In order to obtain a homogeneous solid dispersion of an organic silver salt of small grain sizes having a high S/N ratio and containing no aggregate, a large force is preferably applied uniformly within such an extent that the organic silver salt grains as image-forming element are neither damaged nor heated to an excessively elevated temperature. As a dispersion method meeting such requirement, one comprising converting the aqueous dispersion consisting of the organic silver salt and the aqueous dispersant solution to a high-speed stream and then reducing the pressure is preferred.

The details of dispersing apparatuses and technologies used to practice such re-dispersion method are given in, e.g., pp. 357 to 403, Bunsan-kei Reoroji to Bunsanka Gijutsu (Rheology of Dispersion and Dispersion Technology), authored by Toshio Kajiuchi and Hiroki Usui, published by Shinzan-sha Shuppan Co., Ltd., in 1991, pp. 184 to 185, Kagaku Kogaku no Shimpo (Series of Progress in Chemical Engineering) Vol. 24, edited by Tokai Chapter, the Society of Chemical Engineers, Japan, published by Maki Shoten Co., Ltd. in 1990, JP-A-59-49832, U.S. Pat. No. 4,533,254, and JP-A-8-137044, JP-A-8-238848, JP-A-2-261525 and JP-A-1-94933. In the invention, a very fine re-dispersion is preferably performed by sending an aqueous dispersion containing at least an organic silver salt into a pipe by applying a pressure with a high pressure pump, passing the dispersion through a fine slit equipped in the pipe, and then generating an abrupt pressure drop in the dispersion.

Generally, a homogeneous, efficient dispersion is considered to proceed in a high pressure homogenizer by making a full use of (a) the shear stress acting on the dispersoid passing through a narrow gap of about 75 to about 350 $\mu$m width with a high speed under a high pressure, and (b) the impact force generated by the liquid/liquid collision occurring in the highly compressed, narrow space or by the collision of the dispersion against the pipe wall, and further enhancing the cavitation force generated by the subsequent pressure drop. In a Gaulin homogenizer, a famous example of the dispersing apparatus of such type, a mixture to be dispersed which is sent with a high pressure is converted into a high speed stream in a narrow gap formed on a cylindrical surface. Then, the stream collides against the wall by inertia whereby the generated impaction force carries out emulsification and dispersion. A similar liquid/liquid collision takes place in the Y-shaped chamber of a micro fluidizer and a spherical chamber using a spherical check valve described in JP-A-8-103642 to be explained soon. As for liquid/wall collision, the Z-shaped chamber of a micro fluidizer is mentioned. In general, a pressure of 100 to 600 kg/cm$^2$, a flow rate of several to 30 m/sec is adopted, and various modifications are devised to increase the number of collision by fabricating the high-speed flowing part in the form of saw teeth in order to increase the dispersion efficiency. Typical examples of such types of apparatus include Gaulin homogenizer, Micro Fluidizer made by Microfluidex International Corp., the micro fluidizer made by Mizuho Industrial Co., Ltd. and Nanomizer made by Tokushu Kika Kogyo Co., Ltd. Related descriptions are found in JP-A-8-238848 and JP-A-8-103642 and U.S. Pat. No. 4,533,254.

By controlling flow rate, the difference in pressure during the pressure drop and the number of dispersing operation, the organic silver salt can be dispersed to achieve a desired grain size. From the viewpoints of photographic characteristics and grain size, a flow rate of 200 to 600 m/sec and the difference in pressure during the pressure drop of 900 to 3000 kg/cm$^2$ are preferred, but a flow rate of 300 to 600 m/sec and the difference in pressure during the pressure drop of 1500 to 3000 kg/cm$^2$ are more preferred. The dispersing operation, which may be appropriately repeated depending on the requirement, is usually done one to ten times, but, by taking into account manufacturing efficiency, 1 to 3 time repetitions are more preferred. To permit the aqueous dispersion to elevate its temperature too much under a high pressure is not desirable from the viewpoints of dispersion and photographic properties, as the grain size tends to increase under an elevated temperature above 90° C. together with the increase of fog density. Accordingly, either of the operation prior to converting the dispersion to a high pressure, high speed stream, or the one after the pressure reduction, or both of them are preferably carried out with the use of a cooling device so as to keep the temperature of the aqueous dispersion in the range of 5 to 90° C., more preferably 5 to 80° C., and specifically preferably 5 to 65° C. Particularly, during the dispersion under a high pressure of from 1500 to 3000 kg/cm$^2$, cooling with the cooling devices mentioned above is very effective. Suitable cooling devices are selected, depending on the required amount of heat exchange, such as double- or triple-structure tube combined with a static mixer, multipipe heat exchanger, and coiled heat exchanger. To raise heat exchanging efficiency, the diameter, wall thickness and material of the pipes are appropriately selected. A suitable coolant for the cooling device may be selected from well water of 20° C., chilled water of 5 to 10° C. treated with a freezer, and, if needed, ethylene glycol/water mixtures of −30° C., depending on the heat amount to be exchanged.

In finely dividing the solid organic silver salt with use of a dispersant, synthetic anionic polymers such as polyacrylic acid, acrylic acid copolymers, maleic acid copolymers, maleic acid monoester copolymers or acryloylmethylpropanesulfonic acid copolymers, semi-synthetic anionic polymers such as carboxymethyl starch or carboxymethyl cellulose, anionic polymers such as arginic acid or pectinic acid, anionic surfactants described in JP-A-52-92716 and WO88/04794, the compounds described in JP-A-9-179243, well known anionic, nonionic and cationic surfactants, or various conventionally known polymers such as poly(vinyl alcohol), polyvinyl-pyrrolidone, carboxymethyl cellulose, hydroxypropyl cellulose or hydroxypropylmethyl cellulose, or polymeric materials of natural origin such as gelatin can be appropriately used.

As an ordinary method, dry powder or wet cake of the organic silver salt, to which a dispersion aid has been added prior to dispersing operation, is fed, in the form of slurry, to a dispersing apparatus. Alternatively, however, a mixture containing the organic silver salt and a dispersion aid may be subjected to a heat or solvent treatment to provide a powder blend or a wet cake beforehand. The pH of the mixture may be regulated with an appropriate pH-regulating agent before, after or during the dispersion operation.

Besides mechanical dispersion, a process based on pH control may also be employed in which a crude dispersion prepared under a controlled pH value is subjected to a shift of the pH value in the presence of a dispersion aid to cause finer particle formation. For the crude dispersion in such a process, use can be made of an organic solvent, which is usually removed after the formation of finer particles.

A resulting dispersion can be stored under a constant agitation to prevent the sedimentation of the fine particles, or in a highly viscous state with use of a hydrophilic colloid (e.g., in a gelled state with use of gelatin). Further, for the purpose of preventing the propagation of miscellaneous germs during storage, a preservative may be added.

It is desirable that, after dispersed in an aqueous solvent system, the organic silver salt prepared by any of the methods described hereinabove is mixed with an aqueous dispersion of a photosensitive silver salt to prepare a coating mixture used for the production of a photosensitive image-forming medium.

Prior to fine dispersion, the raw stock liquid is dispersed coarsely (i.e., subjected to preliminary dispersion). Means usable for the coarse dispersion include various known devices (e.g., high-speed mixer, homogenizer, high-speed impact mill, Bambury mixer, homomixer, kneader, ball mill, vibrating ball mill, planet-type ball mill, attritor, sand mill, beads mill, colloid mill, jet mill, roller mill, thoron mill or high-speed stone mill). In addition to mechanical dispersion, a process based on pH control may also be employed in which a crude dispersion in a solvent prepared under a controlled pH value is subjected to a shift of the pH value in the presence of a dispersion aid to cause finer particle formation. For the crude dispersion in such a process, use can be made of an organic solvent, which is usually removed after the formation of finer particles.

An aqueous dispersion of a photosensitive silver salt is finely dispersed and then added to the organic silver salt dispersion to provide a coating mixture for the preparation of a photosensitive image-forming media. A photothermographic material prepared with such a coating mixture has advantages of low haze, low fog and high sensitivity. In contrast, if a photosensitive silver salt is present during the dispersion conducted by converting to a high pressure, high-speed stream, the resulting photosensitive material shows an increased fog as well as a noticeable sensitivity drop. When an organic solvent instead of water is used as dispersion medium, not only increased haze and fog result but also the sensitivity tends to fall. On the other hand, when the so-called conversion technique is adopted whereby part of the organic silver salt in the dispersion is converted to a photosensitive silver salt instead of mixing an aqueous dispersion of a photosensitive silver salt, the sensitivity decreases.

In the process described above, the aqueous dispersion subjected to the dispersion operation based on the conversion of a high-pressure, high-speed stream substantially contains no photosensitive silver salt, the content of the photosensitive silver salt not exceeding 0.1 mole % relative to mole photo-insensitive organic silver salt as a result of no intentional addition of a photosensitive silver salt.

The particle size (the volume-weighted average diameter) of the organic silver salt in the form of finely divided solid dispersion can be obtained by, e.g., irradiating laser light to the organic silver salt dispersed in a liquid, and deriving the auto-correlation function for the temporal change in the fluctuation of the light scattered by the dispersion. Finely divided solid dispersions having an average particle size of from 0.05 to 10.0 $\mu$m are preferred, those having an average particle size of from 0.1 to 5.0 $\mu$m are more preferred, still more preferably the particle size being from 0.1 to 2.0 $\mu$m.

The finely divided solid dispersion of an organic silver salt to be preferably used in the invention comprises at least the organic silver salt and water. Though the ratio of the amount of the organic silver salt to that of water is not specifically limited, the organic silver salt preferably accounts for 5 to 50% by weight, more preferably 10 to 30% by weight of the total amount. Although the dispersion aid described previously may be preferably used, the amount thereof is preferably as small as possible within the range suited for minimizing the particle size. Specifically, the use amount of the dispersion aid is preferably from 1 to 30% by weight, more preferably from 3 to 15% by weight relative to the amount of the organic silver salt.

In the invention, a photosensitive material can be prepared by mixing the aqueous dispersion of an organic silver salt with the aqueous dispersion of a photosensitive silver salt whereby the mixing ratio of the organic silver salt to the photosensitive silver salt can be selected appropriately depending on purposes. The ratio of the photosensitive silver salt to the organic silver salt is preferably from 1 to 30 mole %, more preferably from 3 to 20 mole %, and particularly preferably from 5 to 15 mole %. It is often preferably practiced, in order to control the photographic characteristics, to use two or more kinds of aqueous organic silver salt dispersions with two or more kinds of aqueous photosensitive silver salt dispersions in such mixing operation.

The use amount of the organic silver salt in the invention may vary according to needs, and generally is preferably between 0.1 and 5 g/m$^2$, more preferably between 1 and 3 g/m$^2$.

The photothermographic material of the invention preferably contains a reducing agent for the organic silver salt. As the reducing agent, any compound (preferably organic compound) that can reduce silver ion to metallic silver may be used. Preferable examples of the reducing agent are given in JP-A-11-65021, paragraph Nos. 0043 to 0045 and EP-A-0803764, from p. 7, line 34 to p.18, line 12.

Specific examples of the reducing agent used in the invention will be enumerated below, but the scope of the invention is not limited by the compounds at all.

(I-1)

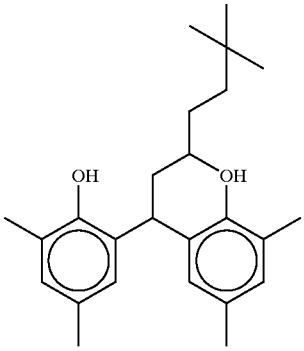

(I-2)

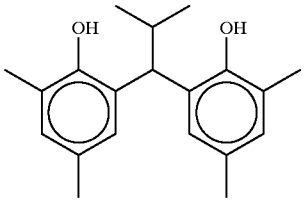

-continued (I-3)

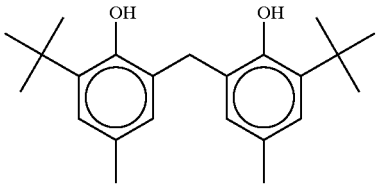

(I-4)

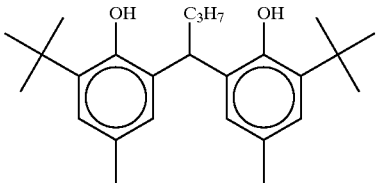

(I-5)

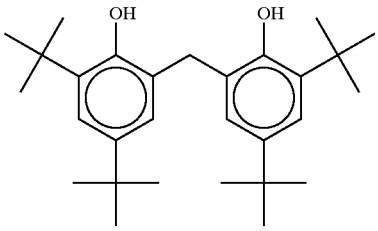

(I-6)

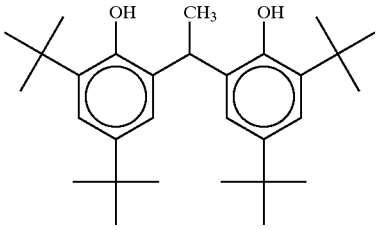

(I-7)

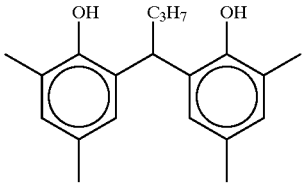

(I-8)

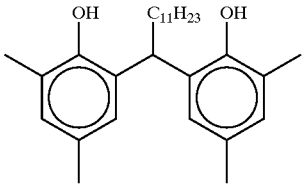

(I-9)

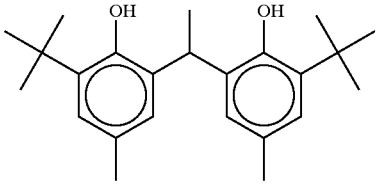

(I-10)

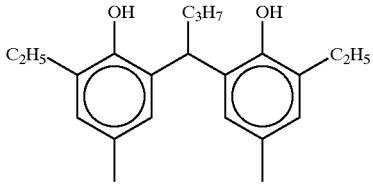

-continued
(I-11)
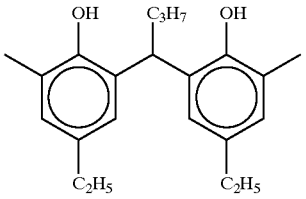
(I-12)
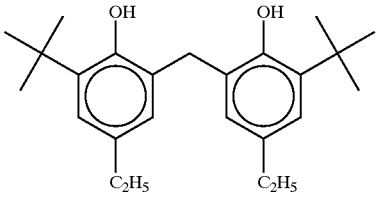
(I-13)
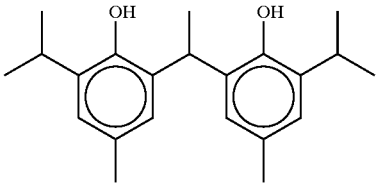
(I-14)
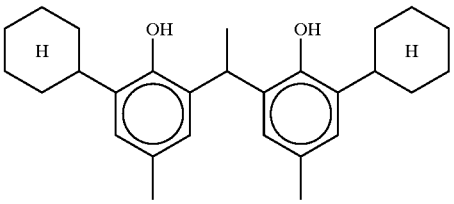
(I-15)
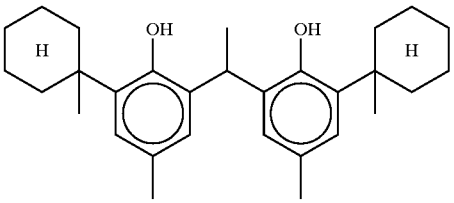
(I-16)
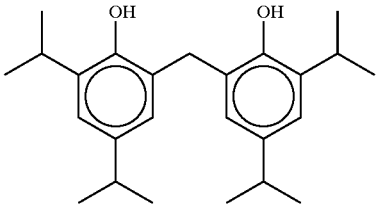
(I-17)
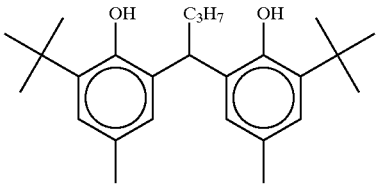
-continued
(I-18)
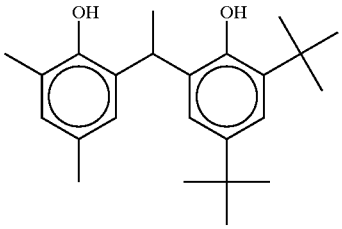
(I-19)
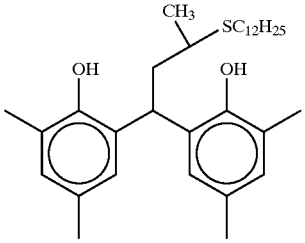
(I-20)
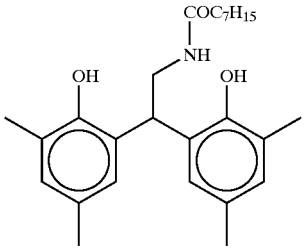
(I-21)
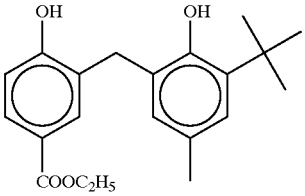
(I-22)
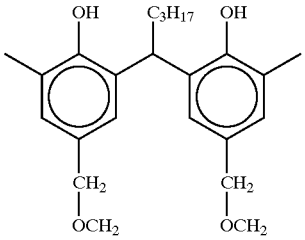
(I-23)
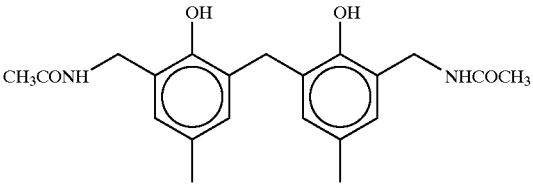

-continued (I-24)

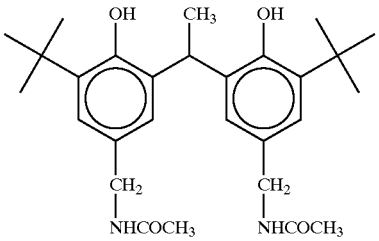

(I-25)

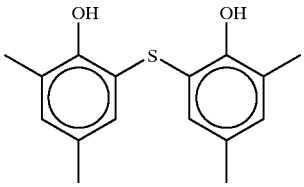

(I-26)

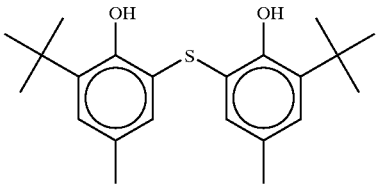

(I-27)

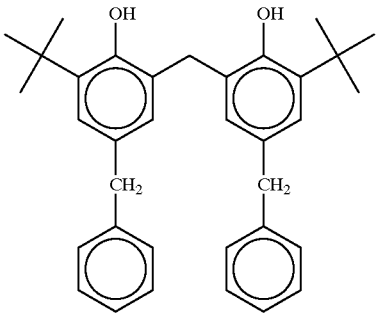

(I-28)

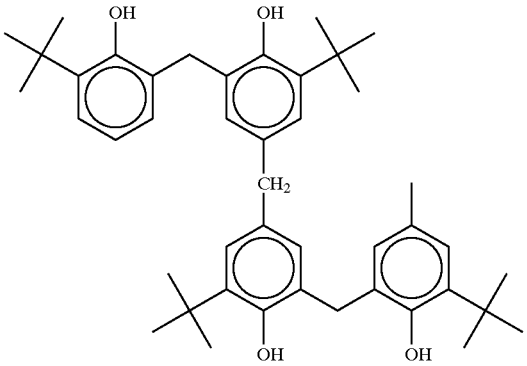

(I-29)

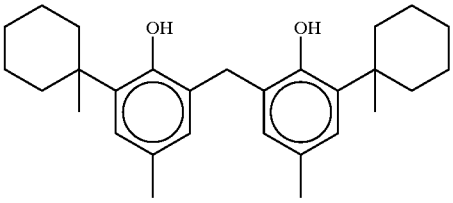

-continued (I-30)

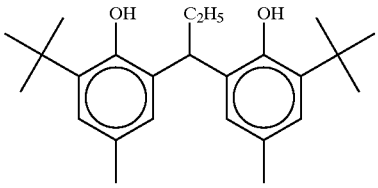

(I-31)

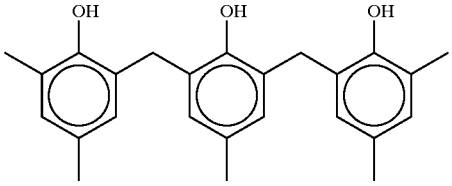

(I-32)

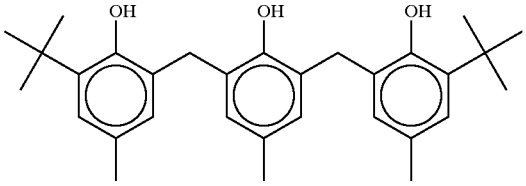

(I-33)

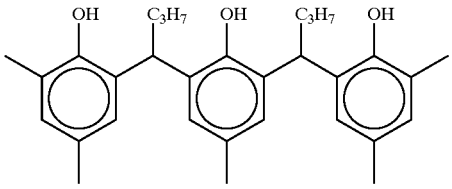

(I-34)

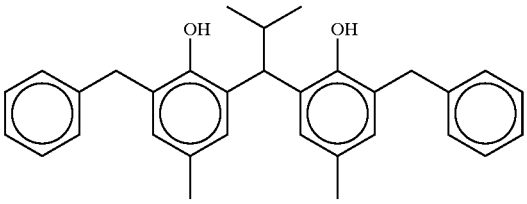

(I-35)

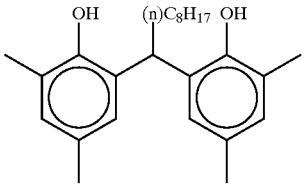

The use amount of the reducing agent is preferably 0.01 to 5.0 g/m$^2$, and more preferably 0.1 to 3.0 g/m$^2$. Relative to 1 mole silver contained in the side having the image-forming layer, the reducing agent is preferably contained in 5 to 50 mole %, and more preferably in 10 to 40 mole %. The reducing agent is preferably incorporated in the image-forming layer.

The reducing agent can be incorporated in the coating mixture in any form including solution, emulsified dispersion, or finely divided solid dispersion to thereby be incorporated in the resulting photosensitive material. An example of well-known emulsification dispersion methods consists of dissolving the reducing agent in an oil such as dibutyl phthalate, tricresyl phthalate, glyceryl triacetate or diethyl phthalate, or in an auxiliary solvent such as ethyl acetate or cyclohexanone, and mechanically dispersing the resulting solution to form an emulsified product.

Finely divided solid dispersions can be prepared by dispersing a pulverized reducing agent in a suitable solvent such as water by means of ball mill, colloid mill, vibrating ball mill, sand mill, jet mill, roller mill or ultrasonic wave. For such procedures, a protective colloid (e.g., poly(vinyl alcohol)) or a surfactant (e.g., anionic surfactant such as sodium triisopropyl-naphthalenesulfonate comprising a mixture of compounds in which the substituted positions of the three isopropyl groups are various). Water dispersion may contain an antiseptic (e.g., sodium salt of benzoisothiazolinone).

The photosensitive silver halide used in the invention has no restriction on the halogen composition, thus including silver chloride, silver chlorobromide, silver bromide, silver iodobromide and silver chloroiodobromide. The distribution of halogen in each grain may be uniform or change stepwise or continuously. Silver halide grains having a core/shell structure can be preferably used. Examples of preferable grain structure include double to fivefold structures; more preferably double to fourfold core/shell structured grains can be used. Further, techniques with which a silver bromide phase is localized on the surface of silver chloride or silver chlorobromide grains are preferably employed.

The preparation of photosensitive silver halides is well known in this field of art, and the preparation processes given, e.g., in RD-17029 disclosed in June 1978 and U.S. Pat. No. 3,700,458 can be used. Specifically, by adding a silver-supplying compound and a halogen-supplying compound into a solution of gelatin or other polymers, a photosensitive silver halide is prepared, which is then mixed with an organic silver salt.

The particle size of the photosensitive silver halide is preferably up to 0.20 $\mu$m, more preferably from 0.01 to 0.15 $\mu$m, still more preferably from 0.02 to 0.12 $\mu$m to suppress the white turbidity after image formation. The particle size herein means the diameter of the sphere having the same volume as the silver halide grain in concern for normal crystals such as cubic or octahedral and for those other than normal ones such as, e.g., spherical or rod-shaped crystals. On the other hand, when the silver halide grains are tabular, the particle size means the diameter of a circle having the area equal to that of the projected area of the main plane of the grain.

Silver halide grains can take various grain shapes including cubic, octahedral, tabular, spherical, rod-like or pebble-like ones, among which cubic grains are especially preferably used for the invention. Grains having rounded corners can also be employed. Though there is no special restriction on the plane indices (Miller indices) of the outer surfaces of photosensitive silver halide grain, it is preferred from the viewpoint of high spectral sensitization efficiency for adsorbed spectral sensitizers to use grains having the {001} plane at a large ratio. The ratio is preferably not lower than 50%, more preferably 65% or more, and still more preferably 80% or more. The ratio of the planes of {100} Miller index can be measured by the method described by T. Tani in J. Imaging Sci., 29, p. 165 (1985) utilizing the dependence of the adsorptive property for sensitizing dyes between the {111} and {100} planes.

The photosensitive silver halide grains for use in the invention contains a metal belonging to the 8th to 10th groups of the periodic table (which consists of first to 18th groups) or a metal complex. Preferable metals belonging to the 8th to 10th groups or as the core of the complex are rhodium, rhenium, ruthenium, osmium and iridium. One metal complex may be used, or two or more metal complexes may be used in combination whereby the same or different metals may be contained in the complexes. A preferable content thereof is from $1\times10^{-9}$ to $1\times10^{-3}$ mole per mole silver. Useful metal complexes are described in paragraph Nos. 0018 to 0024 of JP-A-11-65021.

In practicing the invention, an iridium compound is especially preferably incorporated in silver halide grains. Usable iridium compounds include, e.g., hexachloroiridium, hexaammineiridium, trioxalateiridium, hexacyanoiridium, pentachloronitrosyliridium. Such an iridium compound is used in the form of solution in water or a suitable solvent. Further, the well known method of stabilizing the iridium compound solution comprising the addition of a hydrogen halide aqueous solution (e.g., hydrochloric acid, hydrobromic acid or hydrofluoric acid), or an alkali metal halide (e.g., KCl, NaCl, KBr or NaBr) can also be employed. Instead of using a water-soluble iridium compound, silver halide grains that have been prepared separately and doped with iridium beforehand can be added for dissolution during the preparation of silver halide grains. The added amount of such an iridium compound preferably is in the range of from $1\times10^{-8}$ to $1\times10^{-3}$ mole per mole silver halide, and more preferably from $1\times10^{-7}$ to $5\times10^{-4}$ mole per mole silver halide.

Metal atoms (e.g., $[Fe(CN)_6]^{4-}$) that can be incorporated in the silver halide grains for use in the invention, desalting and chemical sensitization methods applicable to the invention are described in JP-A-11-84574, paragraph Nos. 0046 to 0050, and JP-A-11-65021, paragraph Nos. 0025 to 0031.

Spectral sensitizers used in the invention are those capable of spectrally sensitizing silver halide grains at a desired wavelength range when they are adsorbed on silver halide grains. A spectral sensitizer suited for the spectral characteristics of the light source used to expose the resulting image-recording material can be selected advantageously. As for the spectral sensitizer and the addition method thereof, reference can be made to JP-A-11-65021, paragraph Nos. 0103 to 0109, the compounds represented by formula (II) of JP-A-10-186572, and EP-A-0803764, from p. 19, line 38 to p. 20, line 35. In the invention, the time when a sensitizing dye is added to the silver halide emulsion preferably is in the period from completion of desalting to before coating, and more preferably from completion of desalting to initiation of chemical ripening.

Silver halide grains for use in the invention are preferably chemically sensitized with sulfur, selenium or tellurium sensitization. Examples of the compound preferably used in sulfur, selenium and tellurium sensitization for the invention include various compounds well known in the art such as those described in, e.g., JP-A-7-128768. Among the three sensitizations, tellurium sensitization is particularly useful for the invention. Tellurium sensitizing agents include, e.g., diacyl tellurides, bis(oxycarboyl) tellurides, bis(carbamoyl) tellurides, bis(oxycarboyl) ditellurides, bis(carbamoyl) ditellurides, compounds containing a P═Te bond, tellurocarboxylic acid salts, tellurosulfonates, compounds containing a P—Te bond or tellurocarbonyl compounds. Specifically, the compounds given in the references described in JP-A-11-65021, paragraph No. 0030 are used. In particular, the compounds represented by formula (II), (III) or (IV) of JP-A-5-313284 are preferably used.

In the invention, chemical sensitization that may be conducted at any time in the period from the completion of grain formation to the start of coating can be performed specifically after desalting, (1) prior to, (2) simultaneously with, or (3) after spectral sensitization, or (4) immediately before coating. To carry out chemical sensitization after spectral sensitization is particularly preferred.

The amount of the sulfur, selenium or tellurium sensitizer used in the invention, which depends on the type of silver halide grains as well as chemical ripening conditions, is from $10^{-8}$ to $10^{-2}$ mole, preferably from $10^{-7}$ to $10^{-3}$ mole per 1 mole of silver halide. The conditions for chemical sensitization conducted for the invention have no special limitation, and a pH value of from 5 to 8, a pAg value of from 6 to 11, preferably from 7 to 10, and a temperature of from 40 to 95° C., preferably from 44 to 70° C. are usually adopted.

The photosensitive silver halide emulsion for use in the photosensitive material for the invention may comprise one kind of emulsion or two or more (each differing in, e.g., average grain size, halogen composition, crystal habit or chemical sensitization condition) in combination. The gradation can be regulated by using a plurality of photosensitive silver halides each having a different sensitivity. Techniques related to such regulations are given in JP-A-57-119341, JP-A-53-106125, JP-A-47-3929, JP-A-48-55730, JP-A-46-5187, JP-A-50-73627, and JP-A-57-150841. The sensitivity difference between the emulsions to be used together is preferably not less than 0.2log E wherein E implies illuminance.

The amount of the photosensitive silver halide is preferably, in terms of the coated amount of silver per 1 $m^2$ of the photosensitive material, from 0.03 to 0.6 $g/m^2$, more preferably from 0.05 to 0.4 $g/m^2$, still more preferably from 0.1 to 0.4 $g/m^2$, while, relative to 1 mole of the organic silver salt, the photosensitive silver halide is used preferably from 0.01 to 0.5 mole, more preferably from 0.02 to 0.3, still more preferably 0.03 to 0.25 mole.

As for the mixing method and conditions with which a photosensitive silver halide and an organic silver salt each having been prepared independently are mixed together, there is no special limitation provided that the advantageous features of the invention are fully achieved. Specifically, apparatus including a high-speed mixer, ball mill, sand mill, colloid mill, vibrating mill or homogenizer can be used to blend the silver halide grains with the organic silver salt each having been perfectly prepared. Alternatively, at any time during the preparation of the organic silver salt, the finished photosensitive silver halide may be blended with the organic silver salt and then the organic silver salt may be perfectly prepared.

A preferred timing of introducing the silver halide into the coating mixture for the image-forming layer according to the invention is from 180 to substantially 0 minute before coating, and preferably from 60 minutes to 10 seconds before coating. As for the method and, condition for such introduction, there is no special limitation so long as they do not hinder the achievement of the advantageous effects of the invention. Specific mixing methods include one based on mixing in a tank in such a manner that an average staying period calculated from the addition flow rate and the rate of liquid feeding to the coater is fallen within a desirable period, and one using a static mixer as described in Ekitai Kongo Gijutsu (Liquid Mixing Techniques), authored by N. Harnby, M. F. Edwards and A. W. Nienow, translated by Koji Takahashi (Nikkan Kogyo Shinbun-sha, 1989), Chapter 8.

In the invention, the characteristics of the organic silver salt-containing layer improve when a coating mixture comprising water not less than 30% by weight in the solvent is used and dried, and further when the binder of the organic silver salt-containing layer is soluble or dispersible in an aqueous (water-based) solvent, and in particular consists of a latex of a polymer that has an equilibrium moisture content not exceeding 2% by weight at 25° C., 60% RH. The most preferable latices are those exhibiting an ionic conductivity not exceeding 2.5 mS/cm prepared, e.g., by a purifying treatment with use of separation membrane after polymer synthesis.

The term "aqueous solvent" in which the polymer described above is soluble or dispersible indicates water, or mixtures comprising water and a water-miscible organic solvent in an amount not exceeding 70% by weight (of the total weight). Examples of water-miscible organic solvent include, e.g., alcohols such as methyl alcohol, ethyl alcohol or propyl alcohol, cellosolves such as methyl cellosolve, ethyl cellosolve or butyl cellosolve, ethyl acetate and dimethylformamide.

In cases where a polymer is not in thermodynamically dissolved state but exists in dispersion state, the term "aqueous solvent" will also be used in the present specification.

The "equilibrium moisture content at 25° C., 60% RH" can be expressed as follows by using W1 designating the polymer weight equilibrated under an atmosphere of 25° C., 60% RH, and WO designating the polymer weight in an absolutely dry state at 25° C.

Equilibrium moisture content at 25° C., 60% RH=[(W1−W0)/W0]×100 (% by weight)

As for the definition of moisture content and its measurement, reference can be made to, for example, Kobunshi Kougaku Koza 14, Kobunshi Zairyo Shiken-hou (Polymer Engineering Lecture Series 14, Polymer Material Test Method), edited by the Society of Polymer Science, Japan and published by Chijin Shokan Co., Ltd.

The binder polymer used in the invention preferably exhibits an equilibrium moisture content up to 2% by weight at 25° C., 60% RH, more preferably in a range of from 0.01 to 1.5% by weight, still more preferably in a range of from 0.02 to 1% by weight.

In the invention, polymers that are dispersible in an aqueous solvent are particularly preferred.

Preferable examples of dispersion state include that; of latices in which a solid polymer is dispersed as fine particles, and include one, and that in which polymer molecules are dispersed per se or as micelles.

As preferable embodiments of the invention, hydrophobic resins such as acrylic resin, polyester resin, rubber-type resin (e.g., SBR resin), polyurethane resin, vinyl chloride resin, vinyl acetate resin, vinylidene chloride resin or polyolefin resin can be used. The resin polymers may consist of straight- or branched-chain structure, or be cross-linked. Homopolymers comprising a single kind of monomer or copolymers comprising two or more kinds of monomers can be used. As copolymer, random and block copolymers can be used. The molecular weight of the polymer is in a range of from 5,000 to 1,000,000, preferably from 10,000 to 200,000. Polymers with smaller molecular weights than the described range tend to impart insufficient mechanical strength to the emulsion layer while those with larger molecular weights suffer from poor film-forming property.

The above-defined "aqueous solvent" means a dispersion medium in which water occupies 30% by weight or more of the composition. As preferable dispersed states, emulsified dispersion, micelle dispersion, molecular dispersion of polymers having a hydrophilic portion in the molecule are involved. Among these, latices are particularly preferred.

Specific examples of preferable polymer latices include the following wherein the composition is expressed by raw material monomer, the numerical in the parenthesis means % by weight, and the molecular weight means number-averaged ones.

P-1; latex of -MMA(70)-EA(27)-MAA(3)- (Mol. wt.: 37,000)

P-2; latex of -MMA,(70)-2EHA(20)-St(5)-AA(5)- (Mol. wt.: 40,000)

P-3; latex of -St(50)-Bu(47)-MAA(3)- (Mol. wt.: 45,000)

P-4; latex of -St(68)-Bu(29)-AA(3)- (Mol. wt.: 60,000)

P-5; latex of -St(70)-Bu(27)-IA(3)- (Mol. wt.: 120,000)

P-6; latex of -St(75)-Bu(24)-AA(1)- (Mol. wt.: 108,000)

P-7; latex of -St(60)-Bu(35)-DVB(3)-MAA(2)- (Mol. wt.: 150,000)

P-8; latex of -St(70)-Bu(25)-DVB(2)-AA(3)- (Mol. wt.: 280,000)

P-9; latex of -VC(50)-MMA(20)-EA(20)-AN(5)-AA(5)- (Mol. wt.: 80,000)

P-10; latex of -VDC(85)-MMA(5)-EA(5)-MAA(5)- (Mol. wt.: 67,000)

P-11; latex of -Et(90)-MAA(10)- (Mol. wt.: 12,000)

P-12; latex of -St(70)-2EHA(27)-AA(3)- (Mol. wt.: 130,000)

P-13; latex of -MMA(63)-EA(35)-AA(2)- (Mol. wt.: 33,000)

The symbols used for the description of polymer structure indicate the following monomers. MMA; methyl. methacrylate, EA; ethyl acrylate, MAA; methacrylic acid, 2EHA; 2-ethylhexyl acrylate, St; styrene, Bu; butadiene, AA; acrylic acid, DVB; divinylbenzene, VC; vinyl chloride, AN; acrylonitrile, VDC; vinylidene chloride, Et; ethylene and IA; itaconic acid.

Some of the polymer latices enumerated above are commercially available, and the following products can be used. Acrylic resins include Cevian A-4635, 46583 and 4601 (products of Daicel Chemical Industries, Ltd.), and Nipol Lx811, 814, 821, 820 and 857 (Nippon Zeon Co., Ltd.). Polyester resins include FINETEX ES650, 611, 675 and 850 (Dainippon Ink and Chemicals, Inc.) and WD-size or WMS (Eastman Chemical Co.). Polyurethane resins include HYDRAN AP10, 20, 30 and 40 (Dainippon Ink and Chemicals, Inc.). Rubber-type resins include LACSTAR 7310K, 3307B, 4700H, 7132C (Dainippon Ink and Chemicals, Inc.) and Nipol Lx416, 410, 438C and 2507 (Nippon Zeon Co., Ltd.). Vinylidene chloride resins include L502 and L513 (Asahi Kasei Corp.). Olefin resins include Chemipearl S120, SA100 (Mitsui Chemicals, Inc.).

Each of these polymer latices may be used individually or two or more may be blended for use.

As the polymer latex used in the invention, styrene-butadiene copolymer latices are particularly preferred, whereby the weight ratio of styrene monomer unit to butadiene monomer unit fallen within a range of from 40:60 to 95:5 is preferred. The preferred range for molecular weight has already been mentioned.

Styrene-butadiene copolymer latices preferably used in the invention include, e.g., P-3 to P-8 already mentioned, commercially available LACSTAR-3307B and 7132C, and commercially available Nipol Lx416.

The organic silver salt-containing layer of photographic material of the invention can contain a hydrophilic polymer such as gelatin, poly (vinyl alcohol), methyl cellulose and hydroxypropyl cellulose. Such a hydrophilic polymer may be incorporated in an amount not exceeding 30% by weight, more preferably not exceeding 20% by weight of the total amount of the binder of the organic silver salt-containing layer.

The organic silver salt-containing (i.e., image-forming) layer of the invention is preferably formed with use of a polymer latex. The binder for the organic silver salt-containing layer is preferably used in such a manner that the weight ratio of total binder/organic silver salt be in a range of from 1/10 to 10/1, more preferably from 1/5 to 4/1.

Usually, such an organic silver salt-containing layer acts as a photosensitive (emulsion) layer containing a photosensitive silver halide as a photosensitive silver salt, in which case the weight ratio of total binder/silver halide preferably is in a range of from 400 to 5, more preferably from 200 to 10.

The total amount of the binder for the image-forming layer of the invention is from 0.2 to 30 g/m$^2$, and more preferably from 1 to 15 g/m$^2$. In the image-forming layer for use in the invention, various additives such as a crosslinking agent to crosslink the binder, or a surfactant to improve the coating property of the coating mixture may be incorporated.

The coating mixture to form the organic silver salt-containing layer in the photosensitive material used in the invention utilizes an aqueous solvent containing 30% by weight or more of water. As the ingredient other than water, water-miscible organic solvents such as methyl alcohol, ethyl alcohol, isopropyl alcohol, methyl cellosolve, ethyl cellosolve, dimethylformamide and ethyl acetate can be used. The water content of the solvent of the coating mixture is preferable 50% by weight or more, more preferably 70% by weight or more. Examples of preferable solvent compositions include pure water, mixtures such as water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 expressed by % by weight.

Antifoggants, stabilizers and stabilizer precursors that are applicable to the invention are described in JP-A-10-62899, paragraph No. 0070, and EP-A-0803764, from p. 20, line 57 to p. 21, line 7. Preferable antifoggants for the invention are organic halogen compounds including those described in JP-A-11-65021, paragraph Nos. 0111 to 0112. In particular, the organic polyhalogen compounds represented by formula (II) in JP-A-10-339934 (specifically tribromomethylnaphthylsulfone, tribromomethylphenylsulfone, or tribromomethyl(4-(2,4,6-trimethylpehnylsulfonyl)phenyl) sulfone are preferred.

The method of incorporating an antifoggant of the invention into the photosensitive material includes those used for the incorporation of the reducing agent described hereinbefore, and the organic polyhalogen compound is preferably incorporated in the form of solid fine particle dispersion, too.

As other types of antifoggant, the mercury (II) salts given in JP-A-11-65021, paragraph No. 0113 and benzoic acid and related compounds given in the same patent, paragraph No. 0114 are included.

The photothermographic material of the invention may contain an azolium salt for the purpose of fog prevention. Preferable azolium salts include those represented by formula (XI) of JP-A-59-193447, those described in JP-B-55-12581, and those represented by formula (II) of JP-A-60-153039. Though the azolium salts may be incorporated in any part of the photosensitive material, it is desirable to incorporate it in a layer provided on the side of the support on which the photosensitive layer is coated. More preferably, the azolium salt is incorporated in the organic silver salt-containing layer. The azolium compound may be incorporated in the photosensitive material at any stage in the preparation of the coating mixture. In the case where incorporated in the organic silver salt-containing layer, the azolium compound is incorporated at any stage involved in the organic silver salt preparation and the coating mixture preparation, and a more preferable addition time is during the period of from preparation of the organic silver salt to immediately before coating. The azolium salt may be incorporated in any form including powder, solution and finely divided dispersion. It may be added to the solution of another additive such as sensitizer, reducing agent or agent for controlling the color tone. Although in the invention there is no limitation on the added amount of the azolium salt, a preferable range thereof is from $1\times10^{-6}$ to 2 moles per 1 mole of silver, a more preferable one being from $1\times10^{-3}$ to 0.5 moles per 1 mole of silver.

The photothermographic material of the invention can contain a mercapto compound, a disulfide compound or a thione compound for the purposes of controlling developing activity either by development suppression or promotion, enhancing spectral sensitization efficiency and storability before and after development. Examples of preferable compounds include those given in JP-A-10-62899, paragraph Nos. 0067 to 0069 and those represented by formula (I) of JP-A-10-186572 in which specific compounds are shown in paragraph Nos. 0033 to 0052 and EP-A-0803764, p. 20, lines 36 to 56. Among these compounds, mercapto-substituted heteroaromatic compounds are preferred.

In the photothermographic material of the invention, an agent for controlling the color tone is preferably incorporated. Preferable agents for controlling the color tone are detailed in JP-A-10-62899, paragraph Nos. 0054 to 0055, and EP-A-0803764, p.21, lines 23 to 48. Particularly preferable compounds include phthalazinone, the derivatives and metal salts thereof such as 4-(1-naphthyl)phthalazinone, 6-chlorophthalazinone, 5,7-dimethoxyphthalazinone or 2,3-dihydro-1,4-phthalazinedione; combinations of phthalazinone and a phthalic acid derivative (e.g., phthalic acid, 4-methylphthalic acid, 4-nitrophthalic acid and tetrachlorophthalic anhydride); phthalazines (phthalazine, the derivatives and metal salts thereof such as 4-(1-naphthyl) phthalazine, 6-isopropylphthalazine, 6-tert-butylphthalazine, 6-chlorophthalazine, 5,7-dimethoxyphthalazine and 2,3-dihydrophthalazine); combinations of a phthalazine compound and a phthalic acid derivative (e.g., phthalic acid, 4-methylphthalic acid, 4-nitrophthalic acid and tetrachlorophthalic anhydride). Among these, combinations of a phthalazine compound with a phthalic acid derivative are particularly preferred.

Plasticizers and lubricants usable in the photosensitive layer of the photothermographic material of the invention are given in JP-A-10-65021, paragraph No. 0117 while ultra-high contrast enhancers used to develop ultra-high contrast images are given in the same publication, paragraph No. 0118, and represented by formula (III), (IV) or (V) in JP-A-2000-347345 (specific compounds: Ka 21 to Ka 24). Further, contrast enhancers are described in JP-A-11-65021, paragraph No. 0102.

The photothermographic material of the invention may be provided with a surface protective layer with the purpose of adhesion prevention of the image-forming layer. Techniques on the surface protective layer are given in JP-A-11-65021, paragraph Nos. 0119 to 0120.

As a binder for the surface protective layer for use in the invention, gelatin is preferable, and poly(vinyl alcohol) (PVA) is also preferable. Preferable types of PVA include completely saponified PVA-105 [poly(vinyl alcohol) content: 94.0% by weight or higher, saponification degree: 98.5±0.5 mole %, sodium acetate content: up to 1.5% by weight, volatile ingredient content: up to 5.0% by weight, and viscosity (4% by weight, 20° C.): 5.6±0.4 mPa·s], partially saponified PVA-205 [poly(vinyl alcohol) content: 94.0% by weight, saponification degree: 88.0±1.5 mole %, sodium acetate content: 1.0% by weight, volatile ingredient content: 5.0% by weight, and viscosity (4% by weight, 20° C.): 5.0±0.4 mPa·s], and modified PVA (e.g., MP-102, MP-202, MP-203, R-1130 or R-2105, all commercially available products from Kuraray Co., Ltd.). The coated amount of the poly(vinyl alcohol) per one protective layer is preferably from 0.3 to 4.0 g/m$^2$, especially preferably from 0.3 to 2.0 g/m$^2$.

The preparation temperature of the coating mixture for the image-forming layer for use in the invention is preferably controlled between 30° C. and 65° C., more preferably between 35° C. and less than 60° C., still more preferably between 35° C. and 55° C. It is desirable to keep the temperature of the coating mixture for the image-forming layer just after the addition of a polymer latex between 30 and 65° C. It is further desirable that, prior to the addition of the polymer latex, the mixing of the reducing agent and the organic silver salt has been completed.

The liquid containing the organic silver salt or the coating mixture for the image-forming layer of the photothermographic material of the invention is preferably thixotropic. The term thixotropy means a property of a fluid exhibiting viscosity decrease along with the increase of shear velocity. The viscosity of a fluid can be measured with a variety of devices, among which RFS Fluid Spectrometer manufactured by Rheometric Science, Far East, Ltd. is preferably used at 25° C. The liquid containing the organic silver salt or the coating mixture for the image-forming layer used in the invention preferably has a viscosity at 0.1 $S^{-1}$ shear velocity of from 400 to 100,000 mPa·s, and more preferably 500 to 20,000 mPa·s, while, at 1000 $S^{-1}$ shear velocity, the viscosity is preferably 1 to 200 mpa·s, more preferably 5 to 80 mPa·s.

Various systems showing thixotropy are known as described in, e.g., Koza Reoroji (Lecture Series: Rheology), edited by Kobunshi Kankokai, Kobunshi Ratekkusu (Polymer Latex) authored by Muroi and Morino (published by Kobunshi Kankokai). For a fluid to exhibit thixotropy, the fluid needs to contain finely divided solid particles at a high content. To enhance thixotropy, it is effective to use a viscosity-increasing linear polymeric material, increase the aspect ratio of the solid particles contained in the fluid which solid particles are anisotropic, raise the viscosity with an alkali, or use a surfactant.

The heat-developable photographic emulsion for use in the invention comprises one or more layers provided on a support. A mono-layer structure must contain therein an organic silver salt, a silver halide, a developer, a binder and optional additives including an agent for controlling the color tone, coating aid, other auxiliary agent, etc. depending on needs. In a dual-layer structure, a first emulsion layer (usually contiguous to the support) must contain an organic silver salt and a silver halide, and a second layer or both layers must contain the remaining ingredients. Alternatively, another dual-layer structure is possible whereby a single emulsion layer containing all the essential ingredients is covered with a surface protective layer. A multicolor-photosensitive heat-developable photographic material may comprise two layers for each color, or may contain all the ingredients in a single layer as described in U.S. Pat. No. 4,708,928. In a heat-developable photographic material that uses plural dyes and is sensitive to plural colors, each emulsion layer is separated from each other with use of a functional or non-functional barrier layer (interlayer) therebetween as described in U.S. Pat. No. 4,460,681.

The photosensitive layer of the photothermographic material of the invention can contain a dye or pigment for the purposes of improving the tone of the recorded image, preventing fringes caused by the interference occurring at laser exposure and preventing irradiation. Related techniques are described in detail in WO98/36322. Preferable dyes and pigments used in the photosensitive layer for use in the invention include anthraquinone dyes, azomethine dyes, indaniline dyes, azo dyes, indanthlone pigments belonging to the anthraquinone group (e.g., C.I. Pigment Blue 60), phthalocyanine pigments (e.g., cupper phthalocyanine identified as C.I. Pigment Blue 15, or metal-free phthalocyanine as C.I. Pigment Blue 16), triarylcarbonyl pigments belonging to the mordant lake pigment group, indigo and inorganic pigments (e.g., ultramarine and cobalt blue) Such dye or pigment may be added in any form including solution, emulsion, solid fine particle dispersion or a mordanted state with a polymer mordant. The use amount of the compound which is determined by the degree of light absorption therewith preferably is in the range of from 1 $\mu$g to 1 g per $m^2$ of the photosensitive material.

In the invention, an antihalation layer can be provided in the far side from an exposure light source relative to the photosensitive layer. As for the antihalation layer, descriptions are given in JP-A-11-65021, paragraph Nos. 0123 to 0124.

In the invention, it is preferred to incorporate a decolorizable dye and a base precursor into a photo-insensitive layer of the photothermographic material whereby the photo-insensitive layer acts as a filter or an antihaltion layer. Generally, a photothermographic material contains a photo-insensitive layer in addition to a photosensitive one. Such a photo-insensitive layer can be classified into (1) a protective layer provided above the photosensitive layer (in other words, at a far side from the support), (2) an interlayer provided between a plurality of photosensitive layers, or between the protective layer and the photosensitive layer, (3) a subbing layer provided between the photosensitive layer and the support, and (4) a back layer provided on the side of the support opposite to the photosensitive layer side. A filter layer is formed in the photosensitive material as one belonging to (1) or (2) above, while an antihalation layer belongs to (3) or (4).

The decolorizable dye and a base precursor are preferably incorporated in the same photo-insensitive layer. But they may be incorporated separately in two contiguous photo-insensitive layers. Further, between the two contiguous photo-insensitive layers, there may be provided a barrier layer.

The decolorizable dye may be incorporated in a photo-insensitive layer in the form of solution, emulsion or fine solid particle dispersion. Alternatively, the dye impregnated in a polymer may be added in the coating mixture for the photo-insensitive layer. Such a dye may be incorporated in a photo-insensitive layer with use of a polymer mordant. These incorporation methods are common to those employed to incorporate a dye in an ordinary photothermographic material. Descriptions on the latices used to prepare a dye-impregnated polymer are given in U.S. Pat. No. 4,199,363, West German Patent Laid-Open Nos. 2541274 and 2541230, EP-A-029104, and JP-B-53-41091. The emulsification method with which a dye is added in a solution containing a dissolved polymer is given in WO88/00723.

The use amount of the decolorizable dye is determined depending on the purpose of dye usage. In general, the decolorizable dye is used in such an amount as to give an optical density (absorbance) exceeding 0.1 at the wavelength in concern. More preferably, the optical density is from 0.2 to 2. The amount of dye to obtain such an optical density is usually 0.001 to 1 g/$m^2$, and preferably 0.01 to 0.2 g/$m^2$.

Such a decolorizable dye can be decolorized to have an optical density of 0.1 or lower. Two or more kinds of decolorizable dyes may be used together in thermally decolorizable recording materials or photothermographic materials. Similarly, two or more kinds of base precursors may be used together.

The photothermographic material of the invention is preferably of a single side type, comprising at least one photosensitive layer containing a silver halide emulsion on one side of the support, and a back layer on the other side of the support.

In the invention, a matting agent is preferably incorporated for the purpose of improving transporting property. As for matting agents, descriptions are given in JP-A-11-65021, paragraph Nos. 0126 to 0127. In terms of coated amount per 1 $m^2$ of photosensitive material, the matting agent is used preferably of from 1 to 400 mg/$m^2$, more preferably from 5 to 300 mg/$m^2$.

Although the matte degree of the emulsion surface is arbitrarily designed provided that the so-called stardust defect does not occur, a Bekk second between 30 and 2000 see is preferred, and that between 40 and 1500 see is more preferred for the emulsion surface.

In the invention, as the matte degree of the back layer, the back layer preferably has a Bekk second of 10 to 1200 sec, more preferably of 20 to 800 sec, especially preferably of 40 to 500 sec.

In the invention, the matting agent is preferably incorporated in the outermost surface layer, a layer that will act as the outermost surface layer, a layer that is close to the outer surface or a layer acting as the so-called protective layer.

The back layers applicable to the invention are described in JP-A-11-65021, paragraph Nos. 0128 to 0130.

A hardener may be used in each of the photosensitive layer, protective layer and back layer for the photothermographic material of the invention. Examples of the hardener are described in pp. 77 to 87 of THE THEORY OF THE PHOTOGRAPHIC PROCESS, FOURTH EDITION, authored by T. H. James (published by Macmillan Publishing Co., Inc., 1977), and include the polyvalent metal ions described in p. 78 of the book described above, the polyisocyanates given in U.S. Pat. No. 4,281,060, and JP-A-6-208193, the epoxy compounds given in U.S. Pat. No. 4,791,042 and the vinylsulfone compounds given in JP-A-62-89048.

The hardener is added in the form of solution; the timing of adding the hardener solution into the coating mixture for the protective layer is from 180 to substantially 0 minute before coating, and preferably from 60 minutes to 10 seconds before coating. As for the method and condition for such addition, there is no special limitation so long as they do not hinder the achievement of the advantageous effects of the invention. Specific mixing methods include one based on mixing in a tank in such a manner that an average staying period calculated from the addition flow rate and the rate of liquid feeding to the coater is fallen within a desirable period, and one using a static mixer as described in *Ekitai Kongo Gijutsu* (Liquid Mixing Techniques), authored by N. Harnby, M. F. Edwards and A. W. Nienow, translated by Koji Takahashi (Nikkan Kogyo Shinbun-sha, 1989), Chapter 8.

Surfactants usable in the invention are described in JP-A-11-65021, paragraph No. 0132. In the same publication, paragraph No. 0133 describes usable solvents, paragraph No. 0134 describes supports, paragraph No. 0135 describes static prevention or a conductive layer, and paragraph No. 0136 describes the process of forming color images.

A transparent support may be made colored with a blue dye (e.g., dye-1 in the example of JP-A-8-240877) or colorless. Subbing techniques of the support are given in, e.g., JP-A-11-84574 and JP-A-10-186565. As for the antistatic layer or subbing layer, the techniques given in, e.g., JP-A-56-143430, JP-A-56-143431, JP-A-58-62646 and JP-A-56-120519 may be employed.

The photothermographic material of the invention preferably takes a mono-sheet form in which an image is formed in the photothermographic material itself without using any other sheet material such as an image-receiving sheet.

The photothermographic material of the invention can further contain an antioxidant, stabilizer, plasticizer, UV absorber or coating aid. Each of these additives can be incorporated into the photosensitive layer or photo-insensitive layer. As regards to related techniques, reference can be made to, e.g., WO98/36322, EP-A-803764, JP-A-10-186567 and JP-A-10-18568.

The photothermographic material of the invention can be prepared with use of any coating method. Specifically, extrusion coating, slide coating, curtain coating, impregnation coating, knife coating, flow coating or the coating based on the extrusion with the hoppers described in U.S. Pat. No. 2,681,294 may be employed. Further, the extrusion coating given LIQUID FILM COATING authored by Stephen F. Kistler and Petert M. Schweizer (CHAPMAN & HALL, 1997), pp. 399 to 536, or slide coating are preferably employed. Especially preferred is slide coating. An example of the structure of the slide coater to be used for the slide coating is given as FIG. 11b.1 at p. 427 of the book described above. If desired and necessary, the coating methods described in pp. 399 to 536 of the book described above, U.S. Pat. No. 2,761,791 and British Patent 837,095 can also be employed to conduct a simultaneous coating of two or more layers.

Techniques that can be applied to the photothermographic material of the invention are given in EP-A-803764, EP-A-883022, WO98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934$_1$ JP-A-11-7100, JP-A-11-15105, JP-A-11-24200, JP-A-11-24201, JP-A-11-30832, JP-A-11-84574, JP-A-11-65021, JP-A-11-125880, JP-A-11-129629, JP-A-11-133536 to JP-A-11-133539, JP-A-11-133542 and JP-A-11-133543.

The photothermographic material of the invention can be developed with an arbitrary method, but typically after an imagewise exposure, the material is heated to an elevated temperature for heat development. The preferable development temperature is from 80 to 250° C., more preferably from 100 to 140° C. The development period is preferably from 1 to 180 sec, more preferably 10 to 90 sec, especially preferably 10 to 40 sec.

A preferable heat developing method is one using a plate heater. A preferable heat development using a plate heater is described in JP-A-11-133572. The heat developing apparatus disclosed in the publication develops a visible image by bringing a photothermographic material in which a latent image has been formed into contact with a heating means equipped in the heat developing part thereof. The apparatus comprises a plate heater as the aforementioned heating means, and plural suppressing rollers arranged along one side of the plate heater, and is characterized by that the photothermographic material is passed between each suppressing roller and the plate heater to cause heat development. It is preferred to divide the plate heater into 2 to 6 sections, and keep the leading section at a temperature about 1 to 10° C. lower than that of the other sections. Such temperature regulation method, which is described also in JP-A-54-30032, not only allows the moisture or organic solvent involved in the photothermographic material to evaporate therefrom, but also prevents the support of the photothermographic material from distortion caused by abrupt heating.

Though the photothermographic material of the invention may be exposed in a variety of ways, it is preferred to use laser as exposure light source. Suitable laser-emitting devices include gas lasers ($Ar^+$ or He—Ne), YAG laser, dye lasers and semiconductor lasers. Moreover, a semiconductor laser can be used in combination with a second harmonic wave-generating element. Among these, gas lasers and semiconductor lasers emitting red to infrared light are preferred.

Laser light in single mode can be utilized whereby the techniques described in JP-A-11-65021, paragraph 0140 can be adopted.

Laser output power is preferably 1 mW or higher, more preferably 10 mW or higher, and especially preferably 40 mW or higher. Plural lasers may be combined. The spot diameter of the laser beam is regulated to about 30 to 200 $\mu$m in terms of the $1/e^2$ spot size assuming a Gaussian beam.

A commercially available laser imager equipped with an exposure part and a heat developing part is exemplified by Fuji Medical Dry Laser Imager FM-DP L.

The photothermographic material of the invention is preferably used for medical diagnosis, industrial photography, graphic arts applications and COM recording by forming black-and-white silver images. In such applications, though needless to say, the resulting black-and-white image is further used for duplication with a duplication film for medical diagnosis MI-Dup manufactured by Fuji Photo Film Co., Ltd., and as a mask for image formation with a graphic arts contact work film such as DO-175 or PDP-100 manufactured by Fuji Photo Film Co., Ltd. or with an offset printing plate.

The photothermographic material of the invention not only develops sufficiently high image density with practically feasible reaction temperature and time, but also exhibits sufficiently suppressed background coloration when stored for a prolonged period after processing.

The advantageous features of the invention will be explained more in detail with reference to examples and a comparative example. The materials, use amounts, compositions, process details, process orders, etc., can be appropriately modified within the scope of the invention. Accordingly the scope of the invention is not construed as restricted by the following examples.

EXAMPLE 1

<<Preparation of Sub-coated Support>>

(Preparation of PET Support)

By using terephthalic acid and ethylene glycol, poly (ethylene terephthalate) (PET) having an intrinsic viscosity (IV) of 0.66 (measured with a solvent comprising phenol and tetrachloroethane (6/4 in weight ratio) at 25° C.) was synthesized according to a conventional process. After pelletized, the PET was dried at 130° C. for 4 hours, then melted at 300° C. and extruded from a T-shaped die. After extrusion, the polymer was rapidly cooled to give a non-stretched film having a thickness of 175 $\mu$m after heat fixation.

The film was stretched to 3.3 time length along the machine direction by means of a pair of rolls each rotating at a different peripheral speed, then expanded 4.5 times along the transverse direction by means of a tenter. These two operations were carried out at 110° C. and 130° C., respectively. Subsequently, the film was subjected to heat fixation at 240° C. for 20 sec, and then relaxed by 4% along the transverse direction at the same temperature. Then, after the portion fastened by the tenter was cut off, the film was subjected to knurling at both edges, and wound with 4 kg/cm$^2$. A roll of the 175 $\mu$m thick PET support film resulted.

(Surface Corona Processing)

By using a solid-state corona processor Model 6KVA, a product of Pillar Co., Ltd., both surfaces of the support were processed at a rate of 20 m/min. By reading the current and voltage values during the processing, it was confirmed that the support accepted a treatment of 0.375 kV·A·min/m$^2$. The processing frequency was 9.6 kHz and the gap between the electrode and the dielectric roll was 1.6 mm.

(Preparation of Sub-coated Support)

(1) Preparation of a Coating Mixture for Subbing

| Formulation 1 (for subbing the surface on which the image-forming layer is provided) | |
|---|---|
| PES Resin A-515GB (30% by weight solution, a product of Takamatsu Oil and Fat Co., Ltd.) | 234 g |
| Poly(ethylene glycol) monononylphenyl ether (average ethylene oxide mole number = 8.5, 10% by weight solution) | 21.5 g |
| MP-1000 (fine polymer particles with an average diameter of 0.4 $\mu$m, a product of Soken Chemical & Engineering Co., Ltd.) | 0.91 g |
| Distilled water | 744 ml |
| Formulation 2 (for the first layer on the back surface) | |
| Butadiene-styrene copolymer latex (solid content: 40% by weight, butadiene/styrene weight ratio = 32/68) | 158 g |
| 2,4-Dichloro-6-hydroxy-S-triazine sodium salt (8% by weight aqueous solution) | 20 g |
| Sodium laurylbenzenesulfonate (1% by weight aqueous solution) | 10 ml |
| Distilled water | 854 ml |
| Formulation 3 (for the second layer on the back surface) | |
| $SnO_2$/SbO (9/1 in weight ratio, average particle size: 0.038 $\mu$m, 17% by weight dispersion) | 84 g |
| Gelatin (10% by weight aqueous solution) | 89.2 g |
| Metrose TC-5 of Shin-etsu Chemical Co., Ltd. (2% by weight aqueous solution) | 8.6 g |
| MP-1000 of Soken Chemical & Engineering Co., Ltd (polymer fine particle) | 0.01 g |
| Sodium dodecylbenzenesulfonate (1% by weight aqueous solution) | 10 ml |
| NaOH (1% solution) | 6 ml |
| Proxel (a product of ICI, Ltd.) | 1 ml |
| Distilled water | 805 ml |
| (Preparation of sub-coated support) | |

On one (photosensitive layer) side of the corona-processed biaxially stretched PET support of 175 $\mu$m thickness described hereinabove, the sub-coating mixture of formulation 1 was applied with a wire bar so as to give a wet coating amount of 6.6 ml/m$^2$, and dried at 180° C. for 5 min. Then, on the opposite (back) side, the sub-coating mixture of formulation 2 was applied with a wire bar so as to give a wet coating amount of 5.7 ml/m$^2$, and dried at 180° C. for 5 min. Further, the sub-coating mixture of formulation 3 was applied with a wire bar on the backside of the support so as to give a wet coating amount of 7.7 ml/m$^2$, and dried at 180° C. for 6 min. Thus, the sub-coated support was completed.

<<Preparation of Back Coating Mixture>>

(Preparation of Fine Solid Particle Dispersion (a) of Base Precursor)

In 220 ml distilled water, 64 g of base precursor 11, 28 g of diphenylsulfone and 10 g of Demol N, a surfactant of Kao Corp. were mixed, and the resulting mixture was dispersed with beads in a sand mill (a ¼ gallon sand grinder mill manufactured by Imex Co., Ltd.) to prepare a fine solid particle dispersion (a) of the base precursor having an average particle diameter of 0.2 $\mu$m.

(Preparation of Fine Solid Dye Particle Dispersion)

With 305 ml distilled water, 9.6 g of cyanine dye 13 and 5.8 g of sodium p-dodecylbenzenesulfonate were mixed, and the resulting mixture was dispersed with beads with a sand mill (a ¼ gallon sand grinder mill manufactured by Imex Co., Ltd.) to prepare a fine solid particle dispersion of the dye having an average diameter of 0.2 $\mu$m.

(Preparation of Coating Mixture for Antihalation Layer)

A coating mixture for an antihalation layer was prepared by mixing 17 g gelatin, 9.6 g polyacrylamide, 70 g of the above-described fine solid particle dispersion (a) of the base precursor, 56 g of the above-described fine solid dye particle dispersion, 1.5 g of monodispersed fine poly(methyl methacrylate) particle with an average particle size of 8 $\mu$m, 0.03 g benzoisothiazolinone, 2.2 g sodium polystyrenesulfonate, 0.2 g blue dye 14 and 844 ml water.

(Preparation of Coating Mixture for Back Protective Layer)

In a vessel heated to 40° C. was prepared a coating mixture for the back protective layer by mixing the following ingredients.

| | |
|---|---|
| Gelatin | 50 g |
| Sodium polystyrenesulfonate | 0.2 g |
| N,N-ethylenebis (vinylsulfonacetamide) | 2.4 g |
| Sodium tert-octylphenoxyethyoxyethanesulfonate | 1 g |
| Benzoisothiazolinone | 30 mg |
| N-perfluorooctylsulfonyl-N-propylalanine potassium salt | 37 mg |
| Poly(ethylene glycol) mono(N-perfluorooctyl-sulfonyl-N-propyl-2-aminoethyl) ether (average polymerization degree of ethylene oxide: 15) | 0.15 g |
| $C_8F_{17}SO_3K$ | 32 mg |
| $C_8F_{17}SO_2N(C_3H_7)(CH_2CH_2O)_4(CH_2)_4—SO_3Na$ | 64 mg |
| Acrylic acid/ethyl acrylate copolymer (copolymerization weight ratio: 5/95) | 8.8 g |
| Aerozol OT (a product of American Cyanamide Co., Ltd.) | 0.6 g |
| Liquid paraffin emulsion | 1.8 g (as fluid paraffin) |
| Water | 950 ml |

<<Preparation of Silver Halide Emulsion>>

To 1421 ml distilled water, 3.1 ml of 1% by weight potassium bromide solution was added, and after further addition of 3.5 ml of 0.5 mol/l sulfuric acid and 31.7 g phthalated gelatin, the resulting mixture was placed in a reaction vessel made of stainless steel and coated with titanium. To this mixture kept at 34° C. were added under stirring solution A prepared by adding 22.22 g silver nitrate in distilled water followed by dilution with distilled water to 95.4 ml, and solution B prepared by adding 26.3 g potassium bromide in distilled water followed by dilution with distilled water to 161 ml at a constant flow rate in 45 sec. Then, 10 ml of 3.5% by weight aqueous hydrogen peroxide solution, and further 10.8 ml of 10% by weight aqueous benzimidazole solution were added. Next, solution C prepared by adding 51.86 g silver nitrate in distilled water followed by dilution with distilled water to 317.5 ml and solution D prepared by adding 45.8 g potassium bromide in distilled water followed by dilution with distilled water to 400 ml were added whereby solution C was added in 20 min at a constant flow rate, and solution D was added by controlled double-jet method under pAg maintained at 8.1. $K_3Ir(III)Cl_6$ was added in an amount of $1\times10^{-4}$ mole per mole silver ten minutes after the start of the addition of solutions C and D. Further, 5 seconds after the completion of the addition of solution C, $K_4Fe(II)(CN)_6$ aqueous solution was added in an amount of $3\times10^{-4}$ mole per mole silver. After the pH of the mixture was adjusted to 3.8 with 0.5 mol/l sulfuric acid, the agitation was stopped. The mixture was subjected to sedimentation, desalting and washing operations. The pH was adjusted to 5.9 with use of 1 mol/l NaOH to give rise to a silver halide dispersion with a pAg of 8.0.

To the silver halide dispersion obtained in the above-described manner and kept at 38° C., 5 ml of 0.34% by weight methanol solution of 1,2-benzoisothiazoline-3-one was added under stirring, and 40 minutes later a methanol solution of spectral sensitizing dye A was added in an amount of $1\times10^{-3}$ mole per mole silver. One minute thereafter, the dispersion was heated to 47° C. A methanol solution of sodium benzenethiosulfonate was added in an amount of $7.6\times10^{-5}$ mole per mole silver 20 minutes after the temperature elevation, and with an interval of 5 minutes a methanol solution of tellurium sensitizer B was added in an amount of $1.9\times10^{-4}$ mole per mole silver. Thereafter, the dispersion was ripened for 91 minutes. Then, 0.8% by weight methanol solution of N,N'-dihydroxy-N"-diethylmelamine was added by 1.3 ml. With 4 minutes interval, 5-methyl-2-mercaptobenzimidazole and 1-phenyl-2-heptyl-5-mercapto-1,3,4-triazole were added both in the form of methanol solution in amounts of $3.7\times10^{-3}$ mole and $4.9\times10^{-3}$ mole per mole silver, respectively. The resulting product is named silver halide emulsion 1.

The silver halide grains in emulsion 1 consisted of pure silver bromide having an average equivalent sphere diameter of 0.046 μm with a coefficient of variation of 20% for equivalent sphere diameter. The grain size, etc. were obtained by averaging 1000 grains recorded with an electron microscope. The ratio of {100} plane of these grains was determined to be 80% by the Kubelka-Munk method.

<<Preparation of Silver Halide Emulsion 2>>

The operations conducted in the grain formation for silver halide emulsion 1 were performed to prepare silver halide emulsion 2 with the following modifications; the liquid temperature during grain formation was changed from 34° C. to 49° C., the addition period of solution C was expanded to 30 minutes, and $K_3Fe(CN)_6$ was omitted. As in the case of silver halide emulsion 1, sedimentation, desalting, washing and dispersion operations were conducted. Further, the same spectral and chemical sensitizations were conducted as in emulsion 1 except that spectral sensitizing dye A was used by $7.5\times10^{-4}$ mole per mole silver, that tellurium sensitizer B was used by $1.1\times10^{-4}$ mole per mole silver, and that 1-phenyl-2-heptyl-5-mercapto-1,3,4-triazole was used by $3.3\times10^{-3}$ mole per mole silver whereby the additions of 5-methyl-2-mercaptobenzimidazole and 1-phenyl-2-heptyl-5-mercapto-1,3,4-triazole were performed in the same manner as in emulsion 1. The emulsion grains in the resulting silver halide emulsion 2 were pure silver bromide cubic grains having an average equivalent sphere diameter of 0.080 μm with a coefficient of variation of 20% for equivalent sphere diameter.

<<Preparation of Silver Halide Emulsion 3>>

Silver halide emulsion 3 was prepared by following the grain formation operations for silver halide emulsion 1 except that the liquid temperature during grain formation was changed from 34° C. to 27° C. The sedimentation, desalting, washing and dispersion operations in the preparation of emulsion 1 were precisely performed. The same spectral and chemical sensitizations as for emulsion 1 were conducted with alterations that the solid dispersion (in aqueous gelatin solution) of spectral sensitizing dye A was added by $6\times10^{-3}$ mole per mole silver, and that tellurium sensitizer B was added by $5.2\times10^{-4}$ mole per mole silver. The emulsion grains in the resulting silver halide emulsion 3 were pure silver bromide cubic grains having an average equivalent sphere diameter of 0.038 μm with a coefficient of variation of 20% for equivalent sphere diameter.

<<Preparation of Mixed Emulsion A for Use in Coating Mixture>>

The three emulsions 1, 2 and 3 described above were mixed in mixing ratios of 70:15:15 by weight, and to the dissolved mixture 1% by weight aqueous solution of benzothiazolium iodide was added in an amount of $7\times10^{-3}$ mole per mole silver.

<<Preparation of Scaly Fatty Acid Silver Salt>>

A sodium behenate solution was obtained by agitating the mixture of 87.6 kg behenic acid (Product name: Edenor C22-85R, manufactured by Henkel AG), 423 l distilled water, 49.2 l of 5 mol/l NaOH aqueous solution and 120 l tert-butanol at 75° C. for one hour to react with one another. Separately, a $AgNO_3$ aqueous solution of 206.2 l containing 40.4 kg $AgNO_3$ (pH=4.0) was prepared and kept 10° C. Into a reaction vessel charged with 635 l distilled water and 30 l tert-butanol kept at 30° C., the above sodium behenate solution and $AgNO_3$ aqueous solution were added at constant flow rates. The former required 62 min 10 sec and the latter 60 min for total addition, respectively. In the operation, the addition of the $AgNO_3$ aqueous solution preceded by 7 min 20 sec, then the addition of the sodium behenate solution started. Accordingly, after completion of the $AgNO_3$ solution addition, there was a period of 9 min 30 sec during which only the sodium behenate solution was added. During the addition operation, the temperature in the reaction vessel was externally controlled so as to keep 30° C. by which the liquid temperature was maintained constant. Further, the pipeline supplying the sodium behenate solution was temperature-controlled by means of steam tracing, and the steam aperture was regulated so as to keep the temperature of an outlet of a tip of an addition nozzle at 75° C. Further, a pipeline supplying the aqueous solution of $AgNO_3$ was insulted by circulating cool water in the outer space of a double pipe. The positions where the sodium behenate solution and the $AgNO_3$ aqueous solution were injected were symmetrical relative to the center of the agitator axis, and the vertical positions of the nozzles were controlled not to contact the reaction liquid.

After completion of the addition of the sodium behenate solution, the content of the vessel was left for 20 min under stirring at the same temperature, then heated to 36° C. This temperature was kept for 3 hours. Then, the solid matter was separated by centrifugal filtration, and the solid matter was washed with water until the filtrate showed an electric conductivity of 30 μS/cm. The fatty acid silver salt thus obtained was stored in the form of wet cake without further drying.

The shape of the silver behenate particles was examined with electron micrographs; the particles consisted of scaly crystals with A=0.14 μm, B=0.4 μm and C=0.6 μm on average, an average aspect ratio of 5.2, and an average equivalent sphere diameter of 0.52 μm with a coefficient of variation of 15% for equivalent sphere diameter. A, B and C have been defined hereinabove.

To a piece of the wet cake containing 100 g dried solid matter, 7.4 g poly(vinyl alcohol) (Product name: PVA-217) and water were added to make the total amount of 385 g. Then, the mixture was subjected to preliminarily dispersion with a homogenizer.

The preliminarily dispersed mixture was dispersed three times with a disperser (Trade name: Micro Fluidizer M-110S-EH of Microfluidex International Corp. A G10Z interaction chamber was used.) whereby the pressure of the disperser was adjusted to 1750 kg/cm$^2$ to obtain a silver behenate dispersion. The temperature of the mixture was kept at 18° C. during dispersion by arranging coiled heat exchanger ahead and in the back of the interaction chamber and controlling the temperature of the coolant.

<<Preparation of Fine Solid Particle Dispersion of Reducing Agent>>

A slurry was prepared by adding and thoroughly blending 16 kg water to a mixture consisting of 10 kg of 1,1-bis(2-hydroxy-3,5-dimethylphenyl)-3,5,5-trimethyl-hexane as a reducing agent and 10 kg of 20% by weight aqueous solution of modified poly(vinyl alcohol) (Poval MP203 of Kuraray Co., Ltd.). By using a diaphragm pump, this slurry was sent to a horizontal sand mill (UVM-2 of Imex Co., Ltd.) charged with zirconia beads with an average diameter of 0.5 mm where the slurry was subjected to dispersion for 3 hr 30 min. Thereafter, 0.2 g of benzoisothiazolinone sodium salt was added together with water in such an amount as to make the concentration of the reducing agent 25% by weight. The resulting fine solid particle dispersion of the reducing agent proved to contain reducing agent particles having a median diameter of 0.42 μm and the largest particle diameter not exceeding 2.0 μm. The dispersion was filtered through a polypropylene filter with a pore size of 10.0 μm to eliminate foreign matters including dust, and then stored.

<<Preparation of 10% By Weight Dispersion of Mercapto Compound>>

A slurry was prepared by adding and thoroughly mixing 8.3 kg water to a mixture consisting of 5 kg 1-phenyl-2-heptyl-5-mercapto-1,3,4-triazole and 5 kg of 20% by weight aqueous solution of modified poly(vinyl alcohol) (Poval MP203 of Kuraray Co., Ltd.). By using a diaphragm pump, this slurry was sent to a horizontal sand mill (UVM-2 of Imex Co., Ltd.) charged with zirconia beads with an average diameter of 0.5 mm where the slurry was subjected to dispersion for 6 hr. Subsequently, water was added in such an amount as to make the concentration of the mercapto compound 10% by weight. The resulting dispersion of the mercapto compound proved to contain mercapto compound particles having a median diameter of 0.40 μm and the largest particle diameter not exceeding 2.0 μm. The mercapto compound dispersion was filtered through a polypropylene filter with a pore size of 10.0 μm to eliminate foreign matters including dust and then stored. The dispersion was again filtered through a polypropylene filter with a pore size of 10 μm just before use.

<<Preparation of 20% By Weight Dispersion-1 of Organic Polyhalogen Compound>>

A slurry was prepared by adding and thoroughly mixing 10 kg water with 5 kg tribromomethyl-naphthylsulfone, 2.5 kg of 20% by weight aqueous solution of modified poly (vinyl alcohol) (Poval MP203 of Kuraray Co.), and 213 g of 20% by weight aqueous solution of sodium triisopropyl-naphthalenesulfonate. By using a diaphragm pump, this slurry was sent to a horizontal sand mill (UVM-2 of Imex Co., Ltd.) charged with zirconia beads with an average diameter of 0.5 mm where the slurry was subjected to dispersion for 5 hr. Subsequently, together with 0.2 g benzoisothiazolinone sodium salt, water was added in such an amount as to make the concentration of the organic polyhalogen compound 20% by weight. The resulting dispersion of the organic polyhalogen compound proved to contain organic polyhalogen compound particles having a median diameter of 0.36 μm and the largest particle diameter not exceeding 2.0 μm. The organic polyhalogen compound dispersion was stored after filtered through a polypropylene filter with a pore size of 3.0 μm to eliminate foreign matters including dust.

<<Preparation of 30% By Weight Dispersion-2 of Organic Polyhalogen Compound>>

The dispersion operation for the 20% by weight dispersion-1 of organic polyhalogen compound above was performed with exceptions that instead of 5 kg tribromomethylnaphthylsulfone, the same amount of tribromomethylphenylsulphone was used, and that 5 kg of 20% by weight MP203 aqueous solution was used. By dilution and filtration, 30% by weight dispersion of the organic polyhalogen compound-2 was obtained. The resulting dispersion proved to contain organic polyhalogen compound particles having a median diameter of 0.41 μm and the largest particle diameter not exceeding 2.0 μm. This organic polyhalogen compound dispersion was stored after filtered through a polypropylene filter with a pore size of 3.0 μm to eliminate foreign matters including dust. The dispersion was stored at 10° C. or lower until usage.

<<Preparation of 25% By Weight Dispersion-3 of Organic Polyhalogen Compound>>

The dispersion operation for the 20% by weight dispersion-1 of organic polyhalogen compound above was performed with an exception that instead of 5 kg tribromomethylnaphthylsulfone, the same amount of N-butyl-3-tribromomethanesulfonylbenzamide was used. The dispersion was diluted to have a 25% by weight concentration and then filtered. The resulting organic polyhalogen compound dispersion proved to contain organic polyhalogen compound particles having a median diameter of 0.41 μm and the largest particle diameter not exceeding 2.2 μm. This organic polyhalogen compound dispersion was stored after filtration through a polypropylene filter with a pore size of 3.0 μm to eliminate foreign matters including dust.

<<Preparation of 5% By Weight Solution of Phthalazine Compound>>

In 174.57 kg water, 8 kg modified PVA, Poval MP203 of Kuraray Co., Ltd., was dissolved, and then, 3.15 kg of 20% by weight aqueous solution of sodium triisoporpylnaphthalenesulfonate and 14.28 kg of 70% by weight aqueous solution of 6-isopropylphthalazine were added to prepare 5% by weight phthalazine solution.

<<Preparation of 20% By Weight Pigment Dispersion>>

To 64 g C.I. Pigment Blue 60 and 6.4 g Demol N of Kao Corp., 250 g water was added to make a slurry. In a vessel, the slurry was charged together with 800 g of zirconia beads having an average diameter of 0.5 mm, and dispersed for 25 hours in a disperser (a ¼ gallon sand grinder mill manufactured by Imex Co., Ltd.). A pigment dispersion was obtained containing pigment particles having an average diameter of 0.21 μm.

<<Preparation of 40% By Weight SBR Latex>>

The SBR latex purified by ultra-filtration was obtained as follows.

A SBR latex comprising -St(68)-Bu(29)-AA(3)-copolymer after diluted to 10 times volume with distilled water was purified with UF-purification module FS03-FC-FUY03A1 (a product of Daicen Membrane System Co., Ltd.) until the ionic conductivity became 1.5 mS/cm. Thereafter, Sandet-BL (a product of Sanyo Chemical Co., Ltd.) was added so as to be 0.22% by weight. Further, NaOH and $NH_4OH$ were added so that the molar ratio of $Na^+$ ion:$NH_4^+$ ion be 1:2.3, and the pH was adjusted to 8.4. The latex concentration became 40% by weight.

The resulting latex contained particles of an average diameter of 0.1 μm, had a concentration of 45%, exhibited an equilibrium moisture content of 0.6% by weight at 25° C. and 60% RH, and an ionic conductivity of 4.2 mS/cm (measured with CM-30S conductivity meter manufactured by DKK-TOA Corp. at 25° C. by using the undiluted (40%) latex), and a pH of 8.2.

<<Preparation of Coating Mixture for Image-forming (Photosensitive) Layer>>

A coating mixture for the image-forming layer was prepared by thoroughly mixing the following ingredients.

| | |
|---|---|
| The pigment aqueous dispersion prepared above (20% by weight) | 1.1 g |
| The organic silver salt dispersion | 103 g |
| Poly(vinyl alcohol) PVA-205 (Kuraray Co. Ltd.) (20% by weight aqueous solution) | 5 g |
| Oxazoline compound shown in Table 3 (40% by weight solid content, made by Nippon Shokubai Co., Ltd.) | See Table 3 |
| The reducing agent dispersion (25% by weight) | 25 g |
| Mixture of the organic polyhalogen compound dispersions 1 and 2 in the weight ratio of 5:3 | 16.3 g |
| The mercapto compound dispersion (10% by weight) | 6.2 g |
| The ultra-filtered, pH-controlled SBR latex (40% by weight) | 106 g |
| The phthalazine compound solution (5% by weight) | 18 ml |
| Silver halide mixed emulsion A | 10 g |

The resulting mixture was sent to a coating die so as to give a coating amount of 70 ml/m$^2$ to perform coating.

The viscosity of the coating mixture thus prepared was measured with Type B viscometer (a product of Tokyo Keiki Co., Ltd.) at 40° C. with a No. 1 roter at 60 rpm, giving 85 mPa·s.

On the other hand, the viscosity values measured with an RFS Fluid Spectrometer (Rheometic Science, Far East Ltd.) were 1500, 220, 70, 40 and 20 mPa·s for shear rates of 0.1, 1, 10, 100 and 1000 sec$^{-1}$ respectively.

<<Preparation of Coating Mixture for Interlayer in Emulsion-coated Side>>

A coating mixture of the following ingredients for the formation of an interlayer was prepared. The pH of the coating mixture was adjusted to 6.8 with NaOH. The coating mixture was supplied to a coating die so as to give a coating amount of 10 ml/m$^2$.

| | |
|---|---|
| Poly(vinyl alcohol) (PVA-205, a product of Kuraray Co., Ltd.) (10% by weight aqueous solution) | 772 g |
| The pigment dispersion (20% by weight) | 5.3 g |
| Latex of methyl methacrylate/styrene/-butyl acrylate/hydroxyethyl methacrylate/-acrylic acid copolymer (copolymerization weight ratio: 64/9/20/5/2) (27.5% by weight) | 226 g |
| Aerosol OT (American Cyanamide Co., Ltd.) (5% by weight aqueous solution) | 2 ml |
| Diammonium phthalate (20% by weight aqueous solution) | 10.5 ml |
| Water to make totally | 880 g |

The viscosity of the above coating mixture measured with a Type B viscometer (a product of Tokyo Keiki Co., Ltd.) at 40° C. with a No. 1 roter at 60 rpm was 21 mpa·s.

<<Preparation of Coating Mixture for First Protective Layer of Emulsion-coated Side >>

A mixture of the following ingredients for the formation of a first protective layer provided on the image-forming layer side was prepared.

| | |
|---|---|
| Inert gelatin (dissolved in water) | 64 g |
| Latex of methyl methacrylate/styrene/-butyl acrylate/hydroxyethyl methacrylate/acrylic acid copolymer (copolymerization weight ratio: 64/9/20/5/2) (27.5% by weight) | 80 g |
| Phthalic acid (10% by weight methanol solution) | 23 ml |
| 4-Methylphthalic acid (10% by weight aqueous solution) | 23 ml |
| Sulfuric acid (0.5 mol/l) | 28 ml |
| Aerosol OT (American Cyanamide Co., Ltd.) (5% by weight aqueous solution) | 5 ml |
| Phenoxyethanol | 0.5 g |
| Benzisothiazolinone | 0.1 g |
| Water to make | 750 g |

The above mixture was added with 26 ml of 4% by weight aqueous solution of chromium alum immediately before coating by means of a static mixer, and supplied to a coating die so as to give a coating amount of 18.6 ml/m$^2$.

The viscosity of the above coating mixture measured with Type B viscometer (a product of Tokyo Keiki Co., Ltd.) at 40° C. with a No. 1 roter at 60 rpm was 17 mpa·s.

<<Preparation of Coating Mixture for Second Protective Layer of Emulsion-coated Side >>

A mixture of the following ingredients for the formation of a second protective layer provided on the image-forming layer side was prepared.

| | |
|---|---|
| Inert gelatin (dissolved in water) | 80 g |
| Latex of methyl methacrylate/styrene/-butyl acrylate/hydroxyethyl methacrylate/acrylic acid copolymer (copolymerization weight ratio: 64/9/20/5/2) (27.5% by weight) | 102 g |
| N-perfluorooctylsulfonyl-N-propylalanine potassium salt (5% by weight solution) | 3.2 ml |
| Poly(ethylene glycol) mono(N-perfluorooctyl-sulfonyl-N-propyl-2-aminoethyl) ether (average polymerization degree of ethylene oxide = 15) (2% by weight aqueous solution) | 32 ml |
| Aerosol OT (American Cyanamide Co., Ltd.) (5% by weight aqueous solution) | 23 ml |
| Finely divided poly(methyl methacrylate) (average diameter: 0.7 μm) | 4 g |
| Finely divided poly(methyl methacrylate) (average diameter: 6.4 μm) | 21 g |
| 4-Methylphthalic acid | 1.6 g |
| Phthalic acid | 4.8 g |
| Sulfuric acid (0.5 mol/l) | 44 ml |
| Benzisothiazolinone | 10 mg |
| Water to make | 650 g |

The above mixture was added with 445 ml of an aqueous solution containing 4% by weight of chromium alum and 0.67% by weight of phthalic acid immediately before coating by means of a static mixer, and supplied to a coating die so as to give a coating amount of 8.3 ml/m$^2$.

The viscosity of the above coating mixture measured with Type B viscometer (a product of Tokyo Keiki Co., Ltd.) at 40° C. with a No. 1 roter at 60 rpm was 9 mPa·s.

<<Preparation of Photothermographic Material Sample>>

On the backside of the subbed support described above, a coating mixture for an antihalation layer and that for a back protective layer were simultaneously coated and dried to give an antihalation back layer.

In the simultaneous multi-layer coating, the coating condition was controlled so as to give a coated amount of 0.04 g/m$^2$ of the finely divided solid dye for the antihalation layer, and a coated amount of 1.7 g/m$^2$ of gelatin for the back protective layer.

On the front side (opposite to the backside) of the support, an emulsion layer (the coated amount of silver halide: 0.14 g/m$^2$), an interlayer, first and second protective layers were coated in this order from the support by slide bead, simultaneous multi-coating to prepare a photothermographic material sample.

The coating speed was 160 m/min with 0.14 to 0.28 mm spacing between the leading edge of the coating die and the support surface; the coating conditions were adjusted so that the coating width be 0.5 mm wider at each edge than the width of the slit from which the coating mixture was ejected whereby the pressure of the reduced pressure chamber was set 392 Pa lower than the atmospheric pressure. The support had been handled with controlling temperature and humidity so as not to be electrostatically charged, and further exposed to ion flow to eliminate static charges prior to coating. After passing the coating die, the coated fluid was cooled in an adjacent chilling zone by blowing an air stream having a dry bulb temperature of 18, and a wet bulb one of 12° C. for 30 sec. Then, to evaporate the coating solvent, the coated film was transported into a helical path floating mode drying zone where the film was dried with a dry air having a dry bulb temperature of 30° C. and a wet bulb temperature of 18° C. for 200 sec, then passed through a second drying zone kept at 70° C. in 20 sec, and further through a third drying zone kept at 90° C. in 10 sec. Thereafter, the film was cooled to 25° C. The average velocity of the air flow hitting the coated surface in the chilling zone and the drying zones was 7 m/sec.

The matte degree of the thus finished photothermographic material was 550 sec for the emulsion-coated side, and 130 sec for the back surface in terms of Bekk second.

Spectral sensitizing dye A

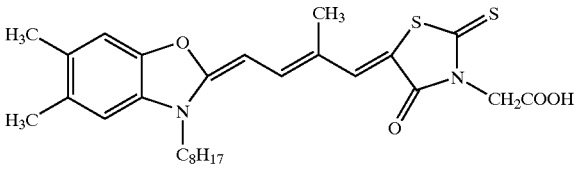

Tellurium sensitizer B

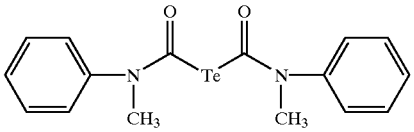

Base precursor 11

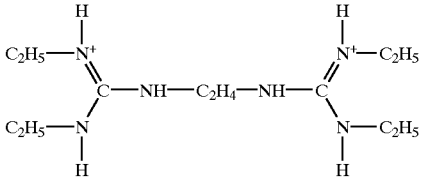

-continued

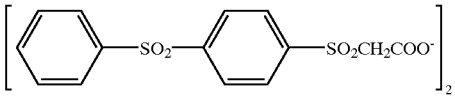

Cyanine dye 13

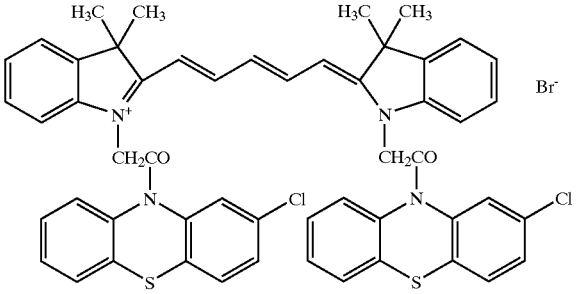

Blue dye 14

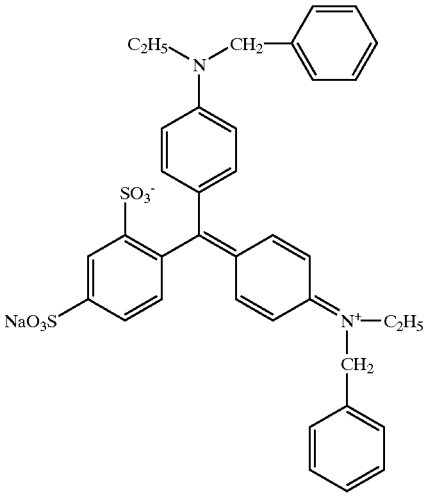

(Evaluation of Photographic Characteristics)

A piece of each sample (101–109) was exposed imagewise and heat-developed (at about 120° C.) with Fuji Medical Dry Laser Imager FM-DP L (installed with a 660 nm semiconductor laser with the maximum output power of 60 mW (IIIB)). The maximum density (Dmax) and the minimum density (Dmin) of the developed image were measured. The Dmax was well within practically usable range (above 3.5) for all the samples, and no substantial difference was observed between sample 101 and samples 102 to 109. The Dmin values are shown in Table 3.

To evaluate the image stability after processing, a piece of each sample was stored in a dark place of 60° C., 50% RH for one dye, and the increment of Dmin (ΔDmin) caused by this storage was measured to give the results shown in Table 3.

TABLE 3

| Sample No. | Oxazoline compound | Coated amount (solid) (g/m$^2$) | Dmin | ΔDmin | |
|---|---|---|---|---|---|
| 101 | — | — | 0.165 | 0.340 | Comparison |
| 102 | K-1030E | 2.09 | 0.153 | 0.217 | This invention |

TABLE 3-continued

| Sample No. | Oxazoline compound | Coated amount (solid) (g/m$^2$) | Dmin | ΔDmin | |
|---|---|---|---|---|---|
| 103 | K-1030E | 4.18 | 0.152 | 0.166 | This invention |
| 104 | K-1020E | 2.09 | 0.156 | 0.298 | This invention |
| 105 | K-1020E | 4.18 | 0.153 | 0.266 | This invention |
| 106 | K-2030E | 1.05 | 0.157 | 0.200 | This invention |
| 107 | K-2030E | 2.09 | 0.155 | 0.198 | This invention |
| 108 | K-2020E | 1.05 | 0.158 | 0.278 | This invention |
| 109 | K-2020E | 2.09 | 0.154 | 0.240 | This invention |

K-1030E, K-1020E, K-2030E and K-2020E are the product numbers of Epocross (solid content 40% by weight) made by Nippon Shokubai Co., Ltd.

As is evident from Table 3, each of samples 102 to 109 prepared according to the invention exhibits marked suppression in the fog increase to be caused by dark storage after processing.

EXAMPLE 2

In the coating mixture for the emulsion (photosensitive) layer in Example 1, 16.3 g of the 5:3 mixture of organic polyhalogen compound dispersion-1 and dispersion-2 was replaced to 12.4 g of organic polyhalogen compound dispersion-3, and 10 kg of the solid fine particle dispersion of 1,1-bis(2-hydroxy-3,5-dimethyl-phenyl-3,5,5-trimethylhexane as a reducing agent was replaced to each of the compounds shown in Table 4 that was used in the amount shown in the same table. Except these two replacements, the procedures of Example 1 were performed to prepare samples 201 to 209. Furthermore, samples 201' to 209' were prepared as comparative examples in which only the oxazoline compound was omitted. These samples were evaluated as in Example 1.

TABLE 4

| Sample No. | Reducing agent | Amount (g/m$^2$) | Oxazoline compound | Coated weight (solid) (g/m$^2$) | |
|---|---|---|---|---|---|
| 201 | I-1 | 1.5 | K-1030E | 2.1 | This invention |
| 202 | I-3 | 1.0 | K-1030E | 2.1 | This invention |
| 203 | I-4 | 1.0 | K-1030E | 2.1 | This invention |
| 204 | I-6 | 1.0 | K-1030E | 2.1 | This invention |
| 205 | I-12 | 1.0 | K-1030E | 2.1 | This invention |
| 206 | I-16 | 1.0 | K-1030E | 2.1 | This invention |
| 207 | I-19 | 1.0 | K-1030E | 2.1 | This invention |
| 208 | I-20 | 1.0 | K-1030E | 2.1 | This invention |
| 209 | I-22 | 1.0 | K-1030E | 2.1 | This invention |

K-1030E is the product number of Epocross made by Nippon Shokubai Co., Ltd.

As in Example 1, each of samples 201 to 209 prepared according to the invention exhibits marked suppression in the fog increase to be caused by dark storage after processing compared to samples 201' to 209'. At the same time, regardless of the incorporation of the oxazoline compound, every sample exhibited practically acceptable Dmax values (above 3.5).

EXAMPLE 3

The same procedures as for sample 101 of the photothermographic material in Example 1 were performed except that the methyl methacrylate/styrene/butyl acrylate/hydroxyethyl methacrylate/acrylic acid (64/9/20/5/2 in weight ratio) copolymer latex was replaced with each of the oxazoline compounds in the amount both shown in Table 5 to prepare samples 301 to 308.

<<Preparation of Coating Mixture for Interlayer in Emulsion-coated Side>>

A coating mixture of the following ingredients for the formation of an interlayer was prepared and supplied to a coating die so as to give a coating amount of 10 ml/m$^2$.

| | |
|---|---|
| Poly(vinyl alcohol) (PVA-205, a product of Kuraray Co., Ltd.) (10% by weight aqueous solution) | 772 g |
| The pigment dispersion (20% by weight) | 5.3 g |
| Oxazoline latex shown in Table 5 (40% by weight) | 226 g |
| Aerosol OT (American Cyanamide Co., Ltd.) (5% by weight aqueous solution) | 2 ml |
| Diammonium phthalate (20% by weight aqueous solution) | 10.5 ml |
| Water to make totally | 880 g |

The viscosity of the above coating mixture measured with Type B viscometer (a product of Tokyo Keiki Co., Ltd.) at 40° C. with a No. 1 roter at 60 rpm was 28 mPa·s.

These samples were subjected to exposure and processing and evaluated as in Example 1. The results are shown in Table 5.

TABLE 5

| Sample No. | Oxazoline compound | Coated weight (solid) (g/m$^2$) | Dmin | ΔDmin | Note |
|---|---|---|---|---|---|
| 101 | — | | 0.165 | 0.340 | Comparison |
| 301 | K-1030E | 2.09 | 0.155 | 0.224 | This invention |
| 302 | K-1030E | 4.18 | 0.152 | 0.207 | This invention |
| 303 | K-1020E | 2.09 | 0.156 | 0.232 | This invention |
| 304 | K-1020E | 4.18 | 0.153 | 0.202 | This invention |
| 305 | K-2030E | 1.05 | 0.151 | 0.205 | This invention |
| 306 | K-2030E | 2.09 | 0.150 | 0.185 | This invention |
| 307 | K-2020E | 1.05 | 0.153 | 0.214 | This invention |
| 308 | K-2020E | 2.09 | 0.151 | 0.197 | This invention |

As is evident from Table 5, even in the cases where an oxazoline compound is used in the interlayer located contiguous to the organic silver salt-containing layer, the fog increase caused by dark storage is markedly suppressed.

EXAMPLE 4

The same procedures as for the preparation of sample 101 of the photothermographic material in Example 1 were performed expect that the kind and amount of the reducing agent were altered as are shown in Table 6, and the coating mixture for the interlayer on the emulsion-coated side was replaced to the one in which an oxazoline compound was incorporated as follows to prepare samples 401 to 408.

<<Preparation of Coating Mixture for Interlayer in Emulsion-coated Side>>

A coating mixture of the following ingredients for the formation of an interlayer was prepared and supplied to a coating die so as to give a coating amount of 12.6 ml/m$^2$.

| | |
|---|---|
| Poly(vinyl alcohol) (PVA-205, a product of Kuraray Co., Ltd.) (10% by weight aqueous solution) | 772 g |
| The pigment dispersion (20% by weight) | 5.3 g |
| Methyl methacrylate/styrene/butyl acrylate/hydroxyethyl methacrylate/acrylic acid (64/9/20/5/2 in weight ratio) copolymer latex (27.5% by weight) | 226 g |
| Oxazoline latex K-2030E (40% by weight) | 226 g |
| Aerosol OT (American Cyanamide Co., Ltd.) (5% by weight aqueous solution) | 2 ml |
| Diammonium phthalate (20% by weight aqueous solution) | 10.5 ml |
| Water to make totally | 1106 g |

The viscosity of the above coating mixture measured with Type B viscometer (a product of Tokyo Keiki Co., Ltd.) at 40° C. with a No. 1 roter at 60 rpm was 35 mpa·s.

These samples were subjected to exposure and processing and evaluated as in Example 1. The results are shown in Table 6.

TABLE 6

| Sample No. | Reducing agent | Quantity (g/m$^2$) | Oxazoline compound | Coated weight (solid) (g/m$^2$) | Dmin | ΔDmin | Note |
|---|---|---|---|---|---|---|---|
| 401 | I-2 | 1.2 | — | — | 0.162 | 0.480 | Comparison |
| 402 | I-2 | 1.2 | K1030E | 4.18 | 0.158 | 0.225 | The invention |
| 403 | I-3 | 0.9 | — | — | 0.165 | 0.421 | Comparison |
| 404 | I-3 | 0.9 | K1030E | 4.18 | 0.155 | 0.205 | The invention |
| 405 | I-12 | 1.0 | — | — | 0.167 | 0.373 | Comparison |
| 406 | I-12 | 1.0 | K2030E | 2.09 | 0.159 | 0.192 | The invention |
| 407 | I-14 | 1.5 | — | — | 0.162 | 0.269 | Comparison |
| 408 | I-14 | 1.5 | K2030E | 2.09 | 0.153 | 0.188 | The invention |

As is evident from Table 6, even in the cases where an oxazoline compound is used in the interlayer located contiguous to the organic silver salt-containing layer, the fog increase caused by dark storage is markedly suppressed regardless of the type of reducing agent combined.

While the invention has been described in detail and with reference to specific embodiments thereof, it will be apparent to one skilled in the art that various changes and modifications can be made therein without departing from the spirit and scope thereof.

What is claimed is:

1. A photothermographic material comprising a support having provided on at least one side thereof a photosensitive silver halide, a photo-insensitive organic silver salt, a reducing agent for silver ion and a binder, wherein at least one layer constituting said photothermographic material comprises an oxazoline compound, wherein said oxazoline compound is a compound having two or more 2-oxazolyl groups represented by the following formula (1) in the molecule, (1)

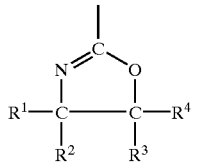

wherein $R^1$, $R^2$, $R^3$ and $R^4$ each independently represents a hydrogen atom, a halogen atom, an alkyl group or an aryl group, wherein $R^1$, $R^2$, $R^3$ and $R^4$ each does not independently represent a hydrogen atom at the same time, and the alkyl group or the aryl group may have a substituent.

2. The photothermographic material as claimed in claim 1, wherein said oxazoline compound is a polymer having the 2-oxazolyl group represented by the formula (1) in the side chain thereof.

3. The photothermographic material as claimed in claim 1, wherein at least one of constitution layer or layers provided on the same side of the support as said layer comprising the photo-insensitive organic silver salt comprises the oxazoline compound.

4. The photothermographic material as claimed in claims 3, wherein said layer comprising the photo-insensitive organic silver salt and one or more layer selected from layer or layers adjacent thereto comprise the oxazoline compound.

5. The photothermographic material as claimed in claim 1, wherein the oxazoline compound is a low molecular weight compound having two or more 2-oxazolyl groups further comprising an organic connecting group between the two 2-oxazolyl groups.

6. The photothermographic material as claimed in claim 5, wherein the connecting group comprises di- or poly-valent aromatic hydrocarbon groups having 6 to 20 carbon atoms, di- or poly-valent aliphatic hydrocarbon groups having 1 to 20 carbon atoms, and combinations of these with —0— or —C(=O)NH—.

7. The photothermographic material as claimed in claim 6, wherein the organic connecting group is selected from the group consisting of a p-phenylene group, an m-phenylene group, a 1,3-naphthylene group, an ethylene group, a butylene group, a xylene group, an octylene group, a 1,2,3-propanetolyl group, a 1,3-propanediyl-2-ilydene group, and $—CH_2CH_2O(C{=}O)NH—(CH_2)_n—NH(C{=}O)OCH_2CH_2—$ (wherein n is 2, 4 or 6).

8. The photothermographic material as claimed in claim 5, wherein the low molecular weight compound containing two or more 2-oxazolyl groups is selected from the group consisting of:

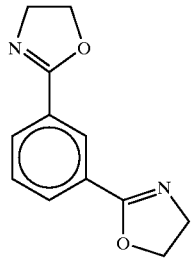

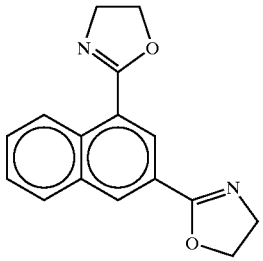

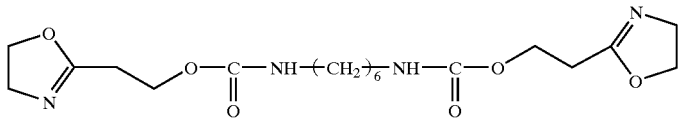

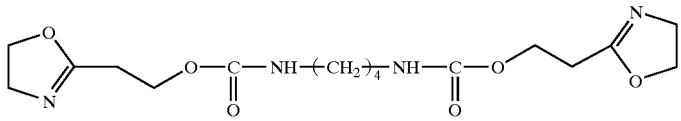

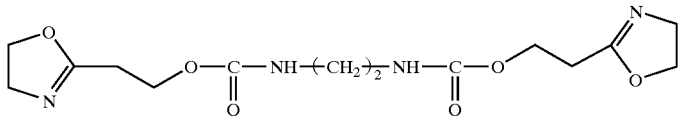

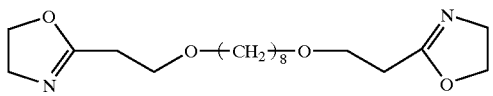

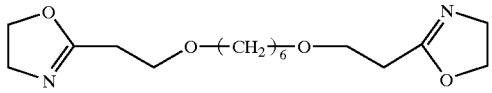

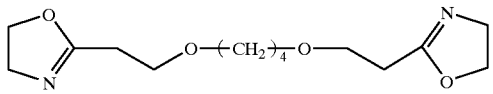

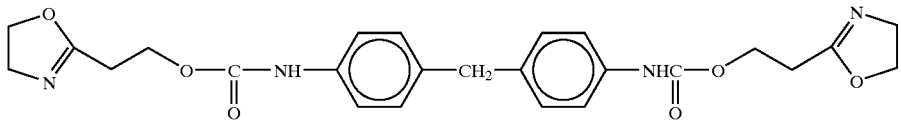

and

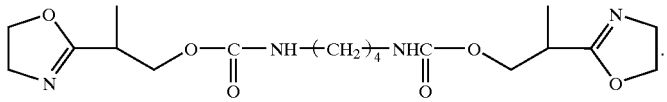

9. The photothermographic material as claimed in claim 2, wherein the polymer comprises a recurring unit having a 2-oxazolyl group in the side chain thereof which is obtained by homopolymerizing a monomer unit containing a 2-oxazolyl group or copolymerizing said monomer with other monomer unit(s) copolymerizable with the 2-oxazolyl group-containing monomer.

10. The photothermographic material as claimed in claim 9, wherein the polymers resulting from the homopolymerization or copolymerization of a monomer represented by the following formula (2) are used alone or in combination with another monomer:

(2)

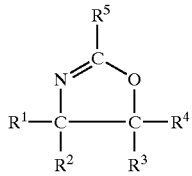

wherein $R^1$, $R^2$, $R^3$ and $R^4$ each independently represents a hydrogen atom, a halogen atom, an alkyl group or an aryl group, wherein $R^1$, $R^2$, $R^3$ and $R^4$ each does not independently represent a hydrogen atom at the same time, and the alkyl group or the aryl group may have a substituent, and $R^5$ represents an organic group having an unsaturated bond that can undergo addition polymerization.

11. The photothermographic material as claimed in claim 10, wherein the monomers are selected from the group consisting of 2-vinyl-2-oxazoline, 2-vinyl-4-methyl-2-oxazoline, 2-vinyl-5-ethyl-2-oxazoline, 2-isopropenyl-2-oxazoline, 2-isopropenyl-4-methyl-2-oxazoline, 2-isopropenyl-4-ethyl-2-oxazoline and 2-propenyl-4-ethyl-2-oxazoline.

12. The photothermographic material as claimed in claim 11, wherein the monomers are selected from the group consisting of 2-vinyl-2-oxazoline and 2-isopropenyl-2-oxazoline, and these monomers can be used in combination of two or more.

13. The photothermographic material as claimed in claim 1, wherein the amount of the oxazoline compound is in a range of 0.5 to 200% by weight of the binder for the constitution layer in which the compound is incorporated.

14. The photothermographic material as claimed in claim 1, wherein the organic silver salt is present in an amount between 0.1 and 5 $g/m^2$.

15. The photothermographic material as claimed in claim 1, wherein the amount of the photosensitive silver halide is, in terms of the coated amount of silver per 1 $m^2$ of the material, from 0.03 to 0.6 $g/m^2$ relative to 1 mole of the organic silver salt, or the photosensitive silver halide is present in an amount from 0.01 to 0.5 mole.

16. A photothermographic material comprising a support having provided on at least one side thereof a photosensitive silver halide, a photo-insensitive organic silver salt, a reducing agent for silver ion and a binder, wherein at least one layer constituting said photothermographic material comprises an oxazoline compound, wherein said oxazoline compound is a compound having two or more 2-oxazolyl groups represented by the following formula (1) in the molecule, (1)

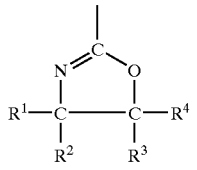

wherein $R^1$, $R^2$, $R^3$ and $R^4$ each independently represents a hydrogen atom, a halogen atom, an alkyl group or an aryl group, wherein $R^1$, $R^2$, $R^3$ and $R^4$ each does not independently represent a hydrogen atom at the same time, and the alkyl group or the aryl group may have a substituent, wherein at least one of constitution layer or layers provided on the same side of the support as said layer comprising the photo-insensitive organic silver salt comprises the oxazoline compound, and wherein the oxazoline compound is a low molecular weight compound having two or more 2-oxazolyl groups further comprising an organic connecting group between the two 2-oxazolyl groups.

* * * * *